US010636561B2

(12) United States Patent
Harada et al.

(10) Patent No.: US 10,636,561 B2
(45) Date of Patent: Apr. 28, 2020

(54) COMMON MODE NOISE FILTER

(71) Applicant: Panasonic Intellectual Property Management Co., Ltd., Osaka (JP)

(72) Inventors: Ryohei Harada, Fukui (JP); Yoshiharu Oomori, Osaka (JP); Kenichi Matsushima, Hyogo (JP); Kenji Ueno, Fukui (JP); Atsushi Shinkai, Fukui (JP)

(73) Assignee: Panasonic Intellectual Property Management, Co., Ltd., Osaka (JP)

( * ) Notice: Subject to any disclaimer, the term of this patent is extended or adjusted under 35 U.S.C. 154(b) by 658 days.

(21) Appl. No.: 15/122,154

(22) PCT Filed: Dec. 7, 2015

(86) PCT No.: PCT/JP2015/006064
§ 371 (c)(1),
(2) Date: Aug. 26, 2016

(87) PCT Pub. No.: WO2016/132410
PCT Pub. Date: Aug. 25, 2016

(65) Prior Publication Data

US 2016/0372254 A1 Dec. 22, 2016

(30) Foreign Application Priority Data

Feb. 19, 2015 (JP) ..... 2015-030475

(51) Int. Cl.
*H01F 17/00* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 2017/0093; H01F 17/0013
See application file for complete search history.

(56) References Cited

U.S. PATENT DOCUMENTS 6,175,293 B1 * 1/2001 Hasegawa ..... H01F 1/15308 336/150
6,480,087 B1 * 11/2002 Oiwa ..... H01F 5/003 336/200
(Continued)

FOREIGN PATENT DOCUMENTS

JP 09-180939 A 7/1997
JP H1197243 A * 4/1999
(Continued)

OTHER PUBLICATIONS

International Search Report of PCT application No. PCT/JP2015/006064 dated Feb. 23, 2016.

*Primary Examiner* — Elvin G Enad
*Assistant Examiner* — Malcolm Barnes
(74) *Attorney, Agent, or Firm* — McDermott Will & Emery LLP

(57) ABSTRACT

A common mode noise filter includes plural non-magnetic layers stacked in a laminating direction, and first, second, and third coil conductors constituting first, second, and third coils which are formed on the non-magnetic layers and are independent from one another. The first and third coil conductors deviate from the second coil conductor in a direction perpendicular to the laminating direction.

30 Claims, 11 Drawing Sheets

(51) Int. Cl.
*H01F 17/04* (2006.01)
*H01F 3/02* (2006.01)

(52) U.S. Cl.
CPC ..... *H01F 3/02* (2013.01); *H01F 2017/0093* (2013.01); *H01F 2027/2809* (2013.01)

(56) References Cited

U.S. PATENT DOCUMENTS 6,498,555 B1 * 12/2002 Sakata ..... H01F 17/0013 336/200
2003/0052766 A1 3/2003 Tomohiro et al.
2003/0134612 A1 * 7/2003 Nakayama ..... H01F 17/0013 455/307
2007/0285202 A1 * 12/2007 Ito ..... H01F 17/0013 336/200
2009/0003191 A1 * 1/2009 Inuzuka ..... H01F 17/0013 369/283
2009/0153283 A1 * 6/2009 Fouquet ..... H01F 27/2804 336/200
2009/0184794 A1 * 7/2009 Tsuzuki ..... H01F 17/0013 336/200
2013/0321115 A1 12/2013 Lee
2014/0198418 A1 * 7/2014 Wang ..... H01L 27/0288 361/56
2014/0232501 A1 * 8/2014 Kato ..... H01F 27/2804 336/182
2014/0306787 A1 * 10/2014 Kato ..... H01F 17/0013 336/105
2014/0312992 A1 * 10/2014 Sim ..... H03H 7/427 333/185
2014/0368307 A1 * 12/2014 Kato ..... H01F 17/0013 336/200
2016/0344181 A1 * 11/2016 Matsunaga ..... H01G 4/005
2017/0025220 A1 * 1/2017 Nakaniwa ..... H01F 27/245

FOREIGN PATENT DOCUMENTS

JP 2001-358017 12/2001
JP 2003-077727 3/2003
JP 2003-173912 A 6/2003
JP 2003173912 A * 6/2003
JP 2004095860 A * 3/2004
JP 2005223262 A * 8/2005
JP 2006-173207 6/2006
JP 2007-150209 6/2007
JP 4367487 B2 * 11/2009 ..... H01F 17/0013
JP 2014-123643 7/2014
KR 10-0745496 B1 8/2007
KR 10-2013-0134075 A 12/2013

* cited by examiner

COMMON MODE NOISE FILTER

CROSS-REFERENCE TO RELATED APPLICATIONS

This application is a U.S. national stage application of the PCT International Application No. PCT/JP2015/006064 filed on Dec. 7, 2015, which claims the benefit of foreign priority of Japanese patent application No. 2015-030475 filed on Feb. 19, 2015, the contents all of which are incorporated herein by reference.

TECHNICAL FIELD

The present invention relates to small and thin common mode noise filters employed in a range of electronic devices, such as digital equipment, audio-visual equipment, and information communication terminals.

BACKGROUND ART

The mobile industry processor interface (mipi) D-PHY standard has been adopted as a digital data transmission standard for connecting a main IC with display or camera in mobile equipment. The standard employs a system of transmitting differential signals via two transmission lines. Upon recent significant increase of camera resolutions, the mipi C-PHY standard is established and put in practical use as a transmission system with a higher speed, using three transmission lines. Different voltages are sent from a transmitter to transmission lines, and the receiver takes a difference among the lines for differential output.

FIG. 9 is an exploded perspective view of conventional common mode noise filter 500. Common mode noise filter 500 includes plural insulation layers 1 and three independent coils 2 to 4. Coils 2 to 4 are formed by electrically coupling coil conductors 2*a* and 2*b*, coil conductors 3*a* and 3*b*, and coil conductors 4*a* and 4*b*. Three coils 2 to 4 are disposed in the laminating direction in this order from the bottom. When a common mode noise is input to this structure, magnetic fields generated in coils 2 to 4 emphasize each other, and allow coils 2 to 4 to function as an inductor for eliminating the noise.

For example, PTL1 discloses a conventional common mode noise filter similar to common mode noise filter 500.

CITATION LIST

Patent Literature

PTL1: Japanese Patent Laid-Open Publication No. 2003-77727

SUMMARY

A common mode noise filter includes non-magnetic layers stacked in a laminating direction, and first, second, and third coil conductors constituting independent first, second, and third coils, respectively, on the non-magnetic layers. The first and third coil conductors deviate from the second coil conductor in a direction perpendicular to the laminating direction.

This common mode noise filter can improve a balance among magnetic coupling between the first coil and the third coil, magnetic coupling between the first coil and the second coil, and magnetic coupling between the second coil and the third coil.

DETAIL DESCRIPTION OF PREFERRED EMBODIMENTS

Figure 9:
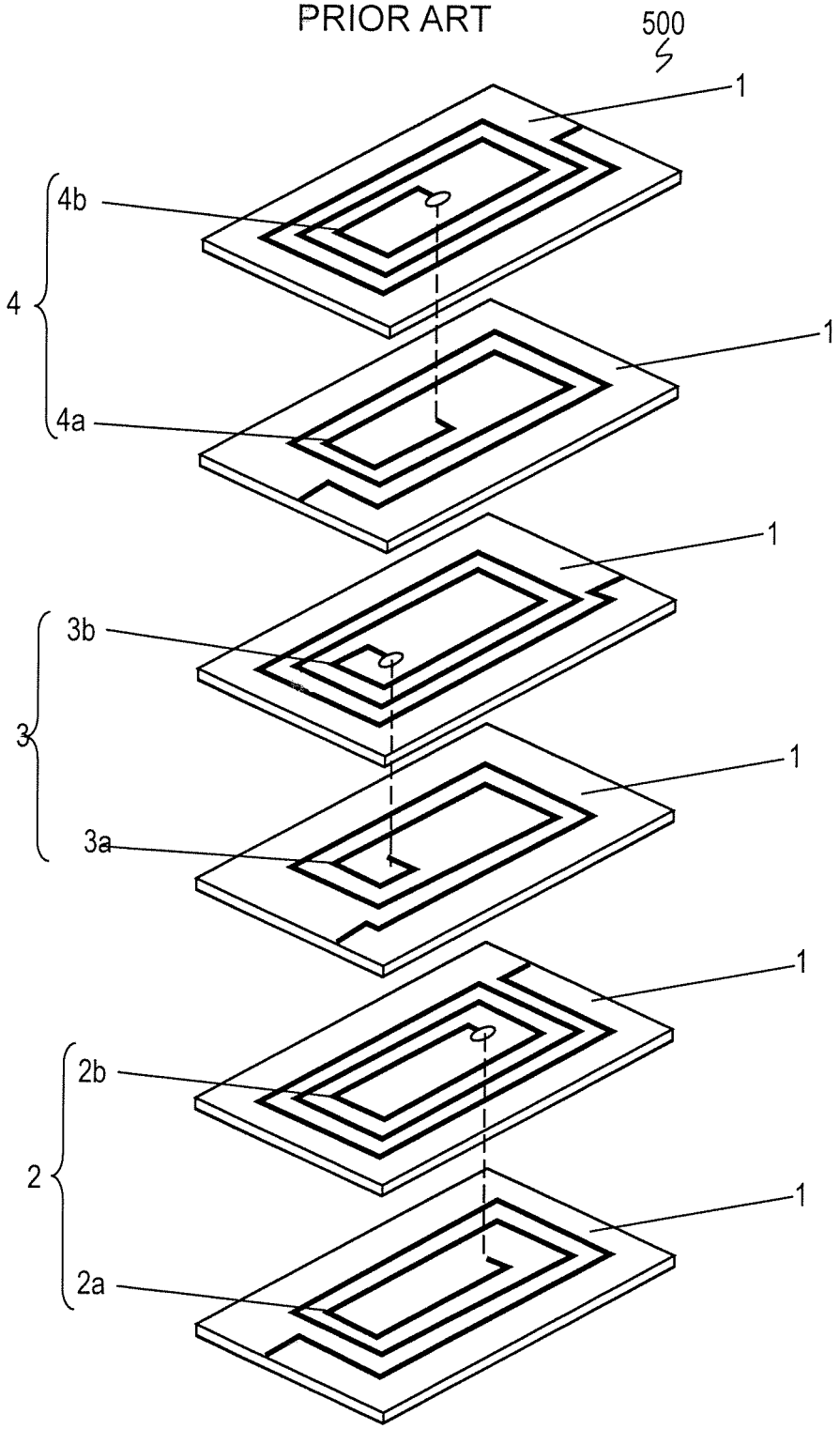
FIG. 9 PRIOR ART
FIG. 9 is an exploded perspective view of a conventional common mode noise filter.

Before describing exemplary embodiments, a disadvantage of conventional common mode noise filter 500 shown in FIG. 9 will be described below.

In conventional common mode noise filter 500, coil 3 is disposed between coil 2 and coil 4. Therefore, coil 2 is far from coil 4, and thus magnetic coupling between coil 2 and coil 4 is hardly established.

If common mode noise filter 500 is applied to aforementioned three-wire differential signal line to transmit differential data signals, coil 2 and coil 4 that are not magnetically coupled to each other cannot cancel magnetic flux generated. Large residual inductance generated by a component not magnetically coupled produces a loss in the differential data signal. This greatly degrades the quality of differential signals.

Figure 10:
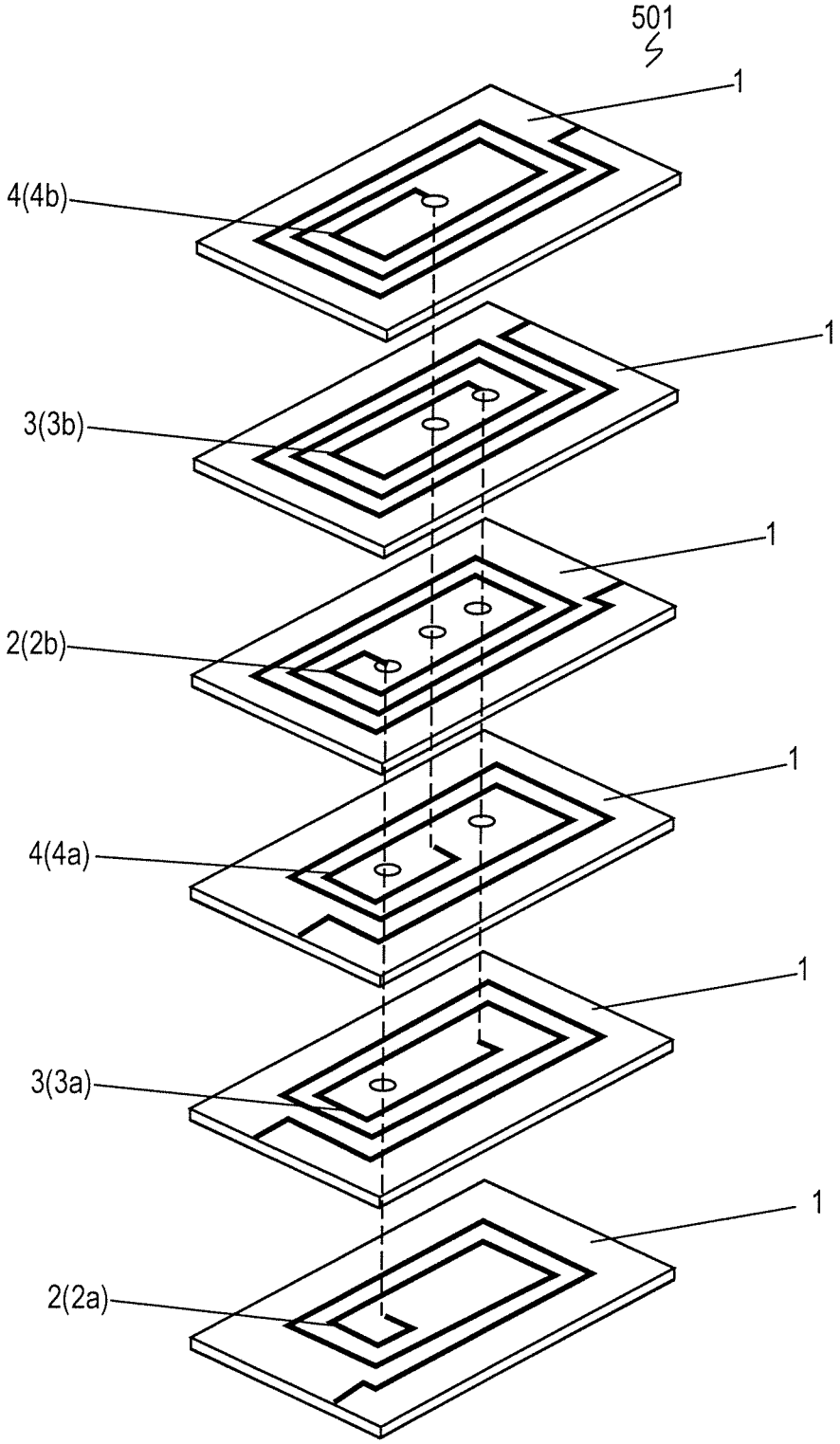
FIG. 10 PRIOR ART
FIG. 10 is an exploded perspective view of a comparative example of a common mode noise filter.

FIG. 10 is an exploded perspective view of a comparative example of common mode noise filter 501. In common mode noise filter 501 shown in FIG. 10, coil conductor 2*a* constituting coil 2, coil conductor 3*a* constituting coil 3, coil conductor 4*a* constituting coil 4, coil conductor 2*b* constituting coil 2, coil conductor 3*b* constituting coil 3, and coil conductor 4*b* constituting coil 4 are stacked in this order. Coil 2 and coil 3 are adjacent to each other at two parts, and coil 3 and coil 4 are adjacent to each other at two parts to enhance magnetic coupling.

However, in common mode noise filter 501, coil 3 is provided between coil 2 and coil 4, and a distance between coils 2 and 4 is long. Therefore, magnetic coupling is smaller than the other parts. This results in poor balance of magnetic coupling between the coils.

When a differential signal is input to common mode noise filter 501, the differential signal has less degradation in coil 3 since it has preferable magnetic coupling with adjacent coil 2 and coil 4. However, even in common mode noise filter 501, a distance between coil conductor 2*b* and coil conductor 4*b* and a distance between coil conductor 4*a* and coil conductor 2*a* are long and thus their magnetic coupling is weak. Accordingly, the differential signal flowing in coil 2 and coil 4 degrades, similarly to common mode noise filter 500.

Common mode noise filters in accordance with exemplary embodiments that can improve the balance among magnetic coupling between two coils far from each other, magnetic coupling between other two coils, and magnetic coupling between still other two coils will be described below with reference to drawings.

Exemplary Embodiment 1

Figure 1A:
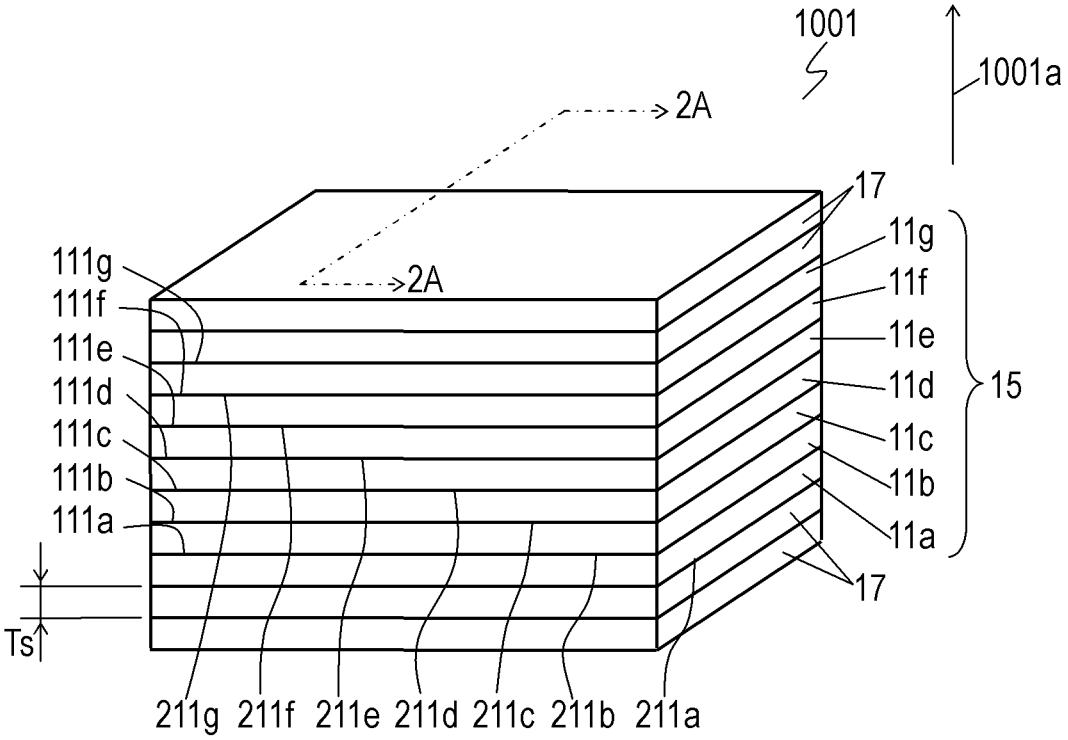
FIG. 1A is a perspective view of a common mode noise filter in accordance with Exemplary Embodiment 1.
Figure 1B:
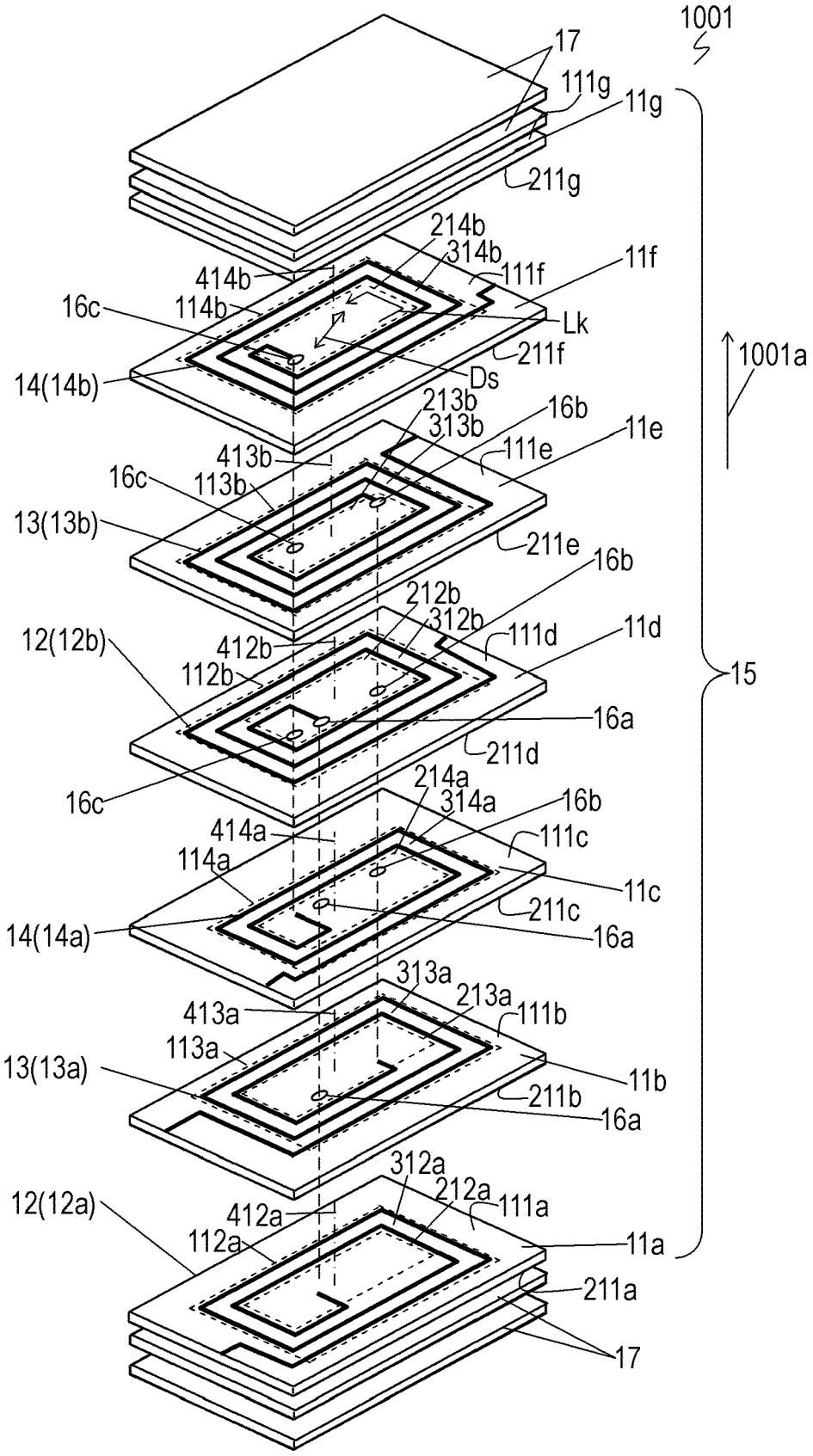
FIG. 1B is an exploded perspective view of the common mode noise filter in accordance with Embodiment 1.
Figure 2A:
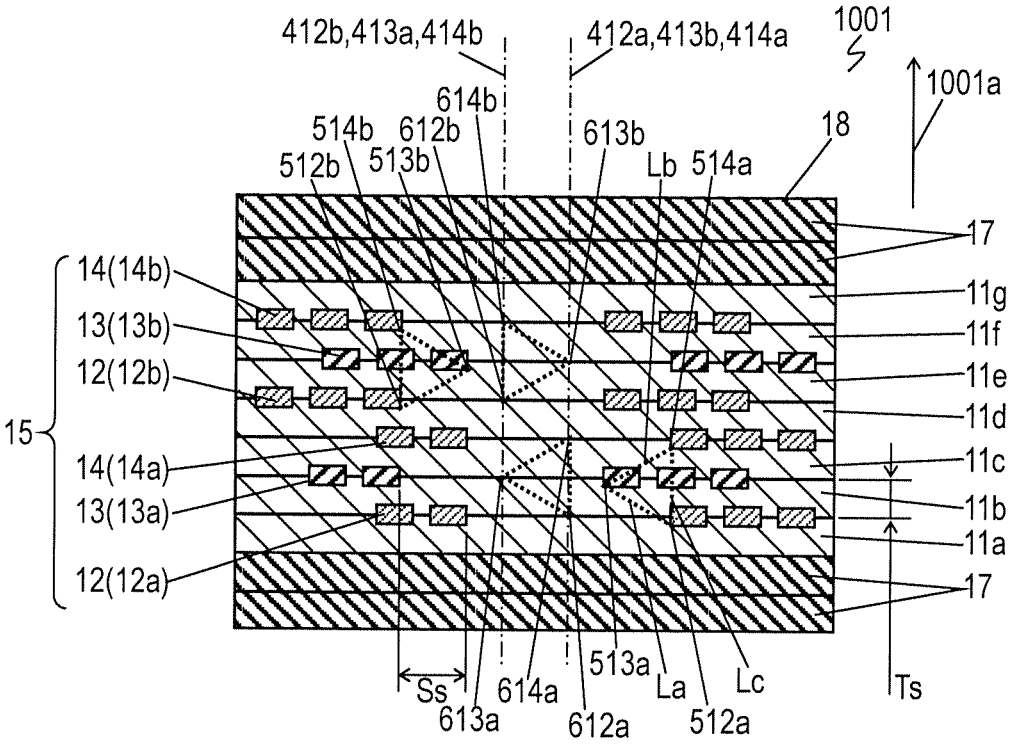
FIG. 2A is a sectional view of the common mode noise filter on line 2A-2A shown in FIG. 1A.

FIG. 1A and FIG. 1B are a perspective view and an exploded perspective view of common mode noise filter 1001 in accordance with Exemplary Embodiment 1, respectively. FIG. 2A is a sectional view of common mode noise filter 1001 on line 2A-2A shown in FIG. 1A.

As shown in FIG. 1B and FIG. 2A, common mode noise filter 1001 in accordance with Embodiment 1 includes non-magnetic layers 11*a* to 11*g*, and coil conductors 12*a*, 12*b*, 13*a*, 13*b*, 14*a*, and 14*b* formed on non-magnetic layers 11*a* to 11*f*. Non-magnetic layers 11*a* to 11*g* have upper surfaces 111*a* to 111*g* and lower surfaces 211*a* to 211*g*, respectively.

Non-magnetic layers 11*a* to 11*g* are stacked in laminating direction 1001*a* in this order from below. Non-magnetic layers 11*a* to 11*g* are made of sheets made of insulating non-magnetic material, such as Cu-Zn ferrite and glass ceramic, with thicknesses Ts identical to each other.

Coil conductors 12*a*, 12*b*, 13*a*, 13*b*, 14*a*, and 14*b* form three coils 12, 13, and 14 independent from each other. More specifically, coil 12 includes coil conductor 12*a* and coil conductor 12*b*, coil 13 includes coil conductor 13*a* and coil conductor 13*b*, and coil 14 includes coil conductor 14*a* and coil conductor 14*b*.

Each of these coil conductors is provided on the upper surface of the non-magnetic layer by plating or printing a conductive material, such as silver, in a spiral shape.

The shapes of the coil conductors will be described below. As shown in FIG. 1B, the coil conductor extends in direction Lk and has a spiral shape of one or more turns composed of longer sides and shorter sides alternately connected between an outer circumference having a rectangular shape and an inner circumference having a rectangular shape. In other words, coil conductor 12*a* has main portion 312*a* having a rectangular ring shape (a rectangular frame shape) provided between rectangular outer circumference 112*a* and rectangular inner circumference 212*a*. In main portion 312*a*, coil conductor 12*a* has a spiral shape with one or more turns composed of longer sides and shorter sides alternately connected and wound about winding axis 412*a*. Coil conductor 12*b* has main portion 312*b* with a rectangular ring shape (rectangular frame shape) provided between rectangular outer circumference 112*b* and rectangular inner circumference 212*b*. In main portion 312*b*, coil conductor 12*b* has a spiral shape with one or more turns composed of longer sides and shorter sides alternately connected and wound about winding axis 412*b*. Coil conductor 13*a* has main portion 313*a* with a rectangular ring shape (rectangular frame shape) provided between rectangular outer circumference 113*a* and rectangular inner circumference 213*a*. In main portion 313*a*, coil conductor 13*a* has a spiral shape with one or more turns composed of longer sides and shorter sides alternately connected and wound about winding axis 413*a*. Coil conductor 13*b* has main portion 313*b* with a rectangular ring shape (rectangular frame shape) provided between rectangular outer circumference 113*b* and rectangular inner circumference 213*b*. In main portion 313*b*, coil conductor 13*b* has a spiral shape with one or more turns composed of longer sides and shorter sides alternately connected and wound about winding axis 413*b*. Coil conductor 14*a* has main portion 314*a* with a rectangular ring shape rectangular frame shape) provided between rectangular outer circumference 114*a* and rectangular inner circumference 214*a*. In main portion 314*a*, coil conductor 14*a* has a spiral shape with one or more turns composed of longer sides and shorter sides alternately connected and wound about winding axis 414*a*. Coil conductor 14*b* has main portion 314*b* with a rectangular ring shape (rectangular frame shape) provided between rectangular outer circumference 114*b* and rectangular inner circumference 214*b*. In main portion 314*b*, coil conductor 14*b* has a spiral shape with one or more turns composed of longer sides and shorter sides alternately connected and wound about winding axis 414*b*.

In accordance with Embodiment 1, the width of the conductor, pitches of the conductors, and the thickness of the conductor in the main portion which is a spiral portion between the outer circumference and the inner circumference other than a portion of the conductor used for wiring are the same in coil conductors 12*a*, 12*b*, 13*a*, 13*b*, 14*a*, and 14*b*.

Coil conductor 12*a* is formed on upper surface 111*a* of non-magnetic layer 11*a*. Coil conductor 13*a* is formed on upper surface 111*b* of non-magnetic layer 11*b*. Coil conductor 14*a* is formed on upper surface 111*c* of non-magnetic layer 11*c*. Coil conductor 12*b* is formed on upper surface 111*d* of non-magnetic layer 11*d*. Coil conductor 13*b* is formed on upper surface 111*e* of non-magnetic layer 11*e*. Coil conductor 14*b* is formed on upper surface 111*f* of non-magnetic layer 11*f*. Non-magnetic layers 11*a* to 11*e* and coil conductors 12*a*, 12*b*, 13*a*, 13*b*, 14*a*, and 14*b* form laminate part 15 such that upper surface 111*a* of non-magnetic layer 11*a* is disposed on lower surface 211*b* of non-magnetic layer 11*b*, upper surface 111*b* of non-magnetic layer 11*b* is disposed on lower surface 211*c* of non-magnetic layer 11*c*, upper surface 111*c* of non-magnetic layer 11*c* is disposed on lower surface 211*d* of non-magnetic layer 11*d*, upper surface 111*d* of non-magnetic layer 11*d* is disposed on lower surface 211*e* of non-magnetic layer 11*e*, upper surface 111*e* of non-magnetic layer 11*e* is disposed on lower surface 211*f* of non-magnetic layer 11*f*, and upper surface 111*f* of non-magnetic layer 11*f* is disposed on lower surface 211*g* of non-magnetic layer 11*g*.

In other words, coil conductor 12*a* constituting coil 12, coil conductor 13*a* constituting coil 13, coil conductor 14*a* constituting coil 14, coil conductor 12*b* constituting coil 12, coil conductor 13*b* constituting coil 13, and coil conductor 14*b* constituting coil 14 are disposed in this order from below.

In laminate part 15, coil conductor 12*a* and coil conductor 12*b* constituting coil 12 are electrically connected with three via-electrodes 16*a* each provided in respective one of non-magnetic layers 11*b* to 11*d*. Coil conductor 13*a* and coil conductor 13*b* constituting coil 13 are electrically connected with three via-electrodes 16*b* each provided in respective one of non-magnetic layers 11*c* to 11*e*. Coil conductor 14*a* and coil conductor 14*b* constituting coil 14 are electrically connected with three via-electrodes 16*c* each provided in respective one of non-magnetic layers 11*d* to 11*f*.

Coil conductor 13*a* constituting coil 13 and coil conductor 14*a* constituting coil 14 are provided between coil conductor 12*a* and coil conductor 12*b* constituting coil 12. Coil conductor 14*a* constituting coil 14 and coil conductor 12*b* constituting coil 12 are provided between coil conductor 13*a* and coil conductor 13*b* constituting coil 13. Coil conductor 12*b* constituting coil 12 and coil conductor 13*b* constituting coil 13 are provided between coil conductor 14*a* and coil conductor 14*b* constituting coil 14.

In other words, between two coil conductors constituting one coil out of coils 12 to 14, total two coil conductors each of which is one of two coil conductors constituting respective one of the coils out of coils 12 to 14 other than the one coil are provided.

This structure provides three coils 12, 13, and 14 independent from each other. Coil 12 and coil 13 are magnetically coupled to each other, coil 13 and coil 14 are magnetically coupled to each other, and coil 14 and coil 12 are magnetically coupled to each other.

In common mode noise filter 1001 in accordance with Embodiment 1, coil conductors 12*a*, 14*a*, and 13*b* formed on non-magnetic layers 11*a*, 11*c*, and 11*e* at odd-numbered orders out of non-magnetic layers 11*a* to 11*f* sequentially stacked in laminating direction 1001*a* deviate from coil conductors 13*a*, 12*b*, and 14*b* provided on non-magnetic layers 11*b*, 11*d*, and 11*f* at even-numbered orders out of non-magnetic layers 11*a* to 11*f* in direction Ds perpendicular to laminating direction 1001*a* of laminate part 15. More specifically, coil conductors adjacent to each other deviate from each other in direction Ds perpendicular to laminating direction 1001*a*. In other words, winding axes of coil conductors adjacent to each other deviate from each other in direction Ds perpendicular to laminating direction 1001*a* in accordance with Embodiment 1.

In accordance with Embodiment 1, as shown in FIG. 1B, direction Ds is diagonal directions of rectangular outer circumferences 112*a* to 114*a* and 112*b* to 114*b* of coil conductors 12*a* to 14*a* and 12*b* to 14*b*. Coil conductors 12*a*, 14*a*, and 13*b* provided on non-magnetic layers 11*a*, 11*c*, and 11*e* at odd-numbered orders, respectively, deviate downward in diagonal direction Ds shown in FIG. 1B. Coil conductors 13*a*, 12*b*, and 14*b* provided on non-magnetic layers 11*b*, 11*d*, and 11*f* at even-numbered orders deviate upward in diagonal direction Ds shown in FIG. 1B.

Coil conductors 12*a*, 14*a*, and 13*b* are disposed such that main parts thereof having the spiral shapes overlap coil conductors 13*a*, 12*b*, and 14*b* viewing in laminating direction 1001*a*.

This configuration enables magnetic coupling to be adjusted by adjusting a distance between coil conductors adjacent to each other. Hence, magnetic coupling between coil 12 and coil 13 and magnetic coupling between coil 13 and coil 14 can be weakened to balance with magnetic coupling between coil 12 and coil 14. Direction Ds is not necessarily the above diagonal direction in the rectangular shape, and may be another direction perpendicular to laminating direction 1001*a*, providing the substantially same effects.

Coil conductor 14*a* and coil conductor 12*b* are arranged to overlap in a top view, i.e., viewing in laminating direction 1001*a*, thereby weakening magnetic coupling between coil 12 and coil 13 that include more pairs of coil conductors adjacent to each other and magnetic coupling of coil 13 and coil 14 that have more pair of coil conductors adjacent to each other to enhance magnetic coupling between coil 12 and coil 14 that include fewer pairs of coil conductors adjacent to each other. Accordingly, magnetic coupling can be balanced among three coils 12, 13, and 14. In this case, other coil conductors deviate in direction Ds perpendicular to laminating direction 1001*a* from a coil conductor adjacent to these coil conductors.

FIG. 2A illustrates a cross section of laminate part 15 parallel to laminating direction 1001A. In common mode noise filter 1001, winding axes 412*b*, 413*a*, and 414*b* of coil conductors 12*b*, 13*a*, and 14*b* are aligned on a single straight while winding axes 412*a*, 413*b*, and 414*a* of coil conductors 12*a*, 13*b*, and 14*a* are aligned on another single straight line. Winding axes 412*b*, 413*a*, and 414*b* deviate in direction Ds from winding axes 412*a*, 413*b*, and 414*a* in direction Ds by deviating amount Ss.

In common mode noise filter 1001 in accordance with Embodiment 1 in which each coil is composed of two coil conductors connected to each other, coil 12 and coil 13 are adjacent to each other at two parts while coil 13 and coil 14 are adjacent to each other at two parts. On the other hand, coil 12 and coil 14 are adjacent to each other only at one part. This configuration more weakens magnetic coupling between coil 12 and coil 13 that have more parts adjacent to each other and magnetic coupling between coil 13 and 14 that have more parts adjacent to each other. Accordingly, the magnetic couplings are balanced among coils 12, 13, and 14.

A coil composed of three or more coil conductors connected to each other can provide the same effects.

Even if a coil is composed of a single coil conductor, magnetic coupling between coil conductors adjacent to each other and magnetic coupling between other coil conductors adjacent to each other can be weakened to balance magnetic coupling with coil conductors away from each other.

The deviating of the coil conductors provided on non-magnetic layers at odd-numbered orders from the coil conductors provided on non-magnetic layers at even-numbered orders in direction Ds perpendicular to laminating direction 1001*a* of laminate part 15 means that a cross section of a portion of the coil conductor at the same order of turn of winding from the inner circumference to outer circumference of the coil conductor deviates in direction Ds perpendicular to laminating direction 1001*a* viewing from the cross section parallel to laminating direction 1001*a*.

The deviating of the cross section of each coil conductor is the deviating of a reference point set to each coil conductor. The reference point is a point in the same direction on the coil conductors. For example, in the case that the coil conductor has a rectangular cross section, the reference point on the coil conductor may be set to the center of the rectangle where diagonal lines of the rectangle cross or a corner of the rectangle. In the case that the coil conductor has an oblong or flat semicircular cross section, the reference point may be set to the center of the width and the thickness.

In accordance with Embodiment 1, deviating amount Ss that is a length by which coil conductors provided on non-magnetic layers at odd-numbered orders deviate from the coil conductors provided on non-magnetic layers at even-numbered order in direction Ds perpendicular to laminating direction 1001*a* of laminate part 15 and thickness Ts of the non-magnetic layers preferably satisfy $0<Ss\leq 2.0\times Ts$.

Deviating amount Ss even slightly more than 0 (zero) provides the aforementioned effect of weakening magnetic coupling to obtain the effect of balancing magnetic coupling among the coils.

As deviating amount Ss increases from 0 (zero), the balance of magnetic coupling among the coils further improve. However, if deviating amount Ss more than twice thickness Ts of the non-magnetic layers unpreferably weakens overall magnetic coupling between coil conductors.

Deviating amount Ss preferably satisfies $1.6 \times Ts \leq Ss \leq 1.8 \times Ts$.

This configuration can increase the number of turns of coils and thus, increases impedance of the coils when common mode noise enters thereto, thus improving the common mode noise elimination capability.

In the above structure, as shown in FIG. 2A, in portions of coil conductors at the same order of turn from the inner circumference to the outer circumference in a cross section parallel to laminating direction 1001*a* of laminate part 15, at portions in the same number of turns from the inner circumference portions (FIG. 2A shows portion at the first turn), a triangular shape formed by line La connecting reference point 512*a* of coil conductor 12*a* to reference point 513*a* of coil conductor 13*a*, line Lb connecting reference point 513*a* of coil conductor 13*a* to reference point 514*a* of coil conductor 14*a*, and line Lc connecting reference point 512*a* of coil conductor 12*a* to reference point 514*a* of coil conductor 14*a* is an equilateral triangle. In other words, three reference points 513*a*, 512*a*, and 514*a* constitute three vertexes of the equilateral triangle. Similarly, in portions at the same order of turn from the inner circumference to the outer circumference in the cross section of laminate part 15 parallel to laminating direction 1001*a*, a triangle formed by a line connecting the reference point of coil conductor 12*b* to the reference point of coil conductor 13*b*, a line connecting the reference point of coil conductor 13*b* to the reference point of coil conductor 14*b*, and a line connecting the reference point of coil conductor 12*b* to a reference point of coil conductor 14*b* is an equilateral triangle. In other words, three reference points 513*b*, 512*b*, and 514*b* constitute three vertexes of the equilateral triangle. Positions of coil conductors 12*a* to 14*a* and 12*b* to 14*b* can be defined by winding axes 412*a* to 414*a* and 412*b* to 414*b*. First, define cross point 612*a* at which winding axis 412*a* of coil conductor 12*a* crosses upper surface 111*a* of non-magnetic layer 11*a* that is a flat surface on which coil conductor 12*a* is arranged is defined. Cross point 613*a* at which winding axis 413*a* of coil conductor 13*a* crosses upper surface 111*b* of non-magnetic layer 11*b* that is a flat surface on which coil conductor 13*a* is arranged is defined. Cross point 614*a* at which winding axis 414*a* of coil conductor 14*a* crosses upper surface 111*c* of non-magnetic layer 11*c* that is a flat surface on which coil conductor 14*a* is arranged is defined. A triangle formed by a line connecting cross point 612*a* to cross point 613*a*, a line connecting cross point 613*a* to cross point 614*a*, and a line connecting cross point 612*a* to cross point 614*a* is an equilateral triangle. In other words, three cross points 612*a*, 613*a*, and 614*a* constitute three vertexes of the equilateral triangle. Similarly, cross point 612*b* at which winding axis 412*b* of coil conductor 12*b* crosses upper surface 111*d* of non-magnetic layer 11*d* that is a flat surface on which coil conductor 12*b* is arranged is defined. Cross point 613*b* at which winding axis 413*b* of coil conductor 13*b* crosses upper surface 111*e* of non-magnetic layer 11*e* that is a flat surface on which coil conductor 13*b* is arranged is defined. Cross point 614*b* at which winding axis 414*b* of coil conductor 14*b* crosses upper surface 111*f* of non-magnetic layer 11*f* that is a flat surface on which coil conductor 14*b* is arranged is defined. A triangle formed by a line connecting cross point 612*b* to cross point 613*b*, a line connecting cross point 613*b* to cross point 614*b*, and a line connecting cross point 612*b* to cross point 614*b* is an equilateral triangle. In other words, three cross points 612*b*, 613*b*, and 614*b* constitute three vertexes of the equilateral triangle. The above positioning enables to provide substantially the same distance between any pair of coil conductors, hence balancing magnetic coupling among the coil conductors. Since three adjacent coil conductors at portions in the same order of turn are disposed at substantially the same distance, magnetic coupling among the coils can be made almost the same. In laminate part 15 as configured above, plural magnetic layers 17 made of a sheet made of magnetic material, such as Ni—Cu—Zn ferrite, are provided below non-magnetic layer 11*a* and above non-magnetic layer 11*g*.

The number of non-magnetic layer 11*a* to 11*g* and magnetic layer 17 is not limited to that indicated in FIG. 1B. Magnetic layer 17 may not be provided, or magnetic layers 17 and other non-magnetic layers may be provided alternately.

Laminate body 18 has the above structure. External electrodes are provided on both end surfaces of laminate body 18, and are connected to ends of coil conductors 12*a*, 12*b*, 13*a*, 13*b*, 14*a*, and 14*b*, respectively.

Figure 2B:
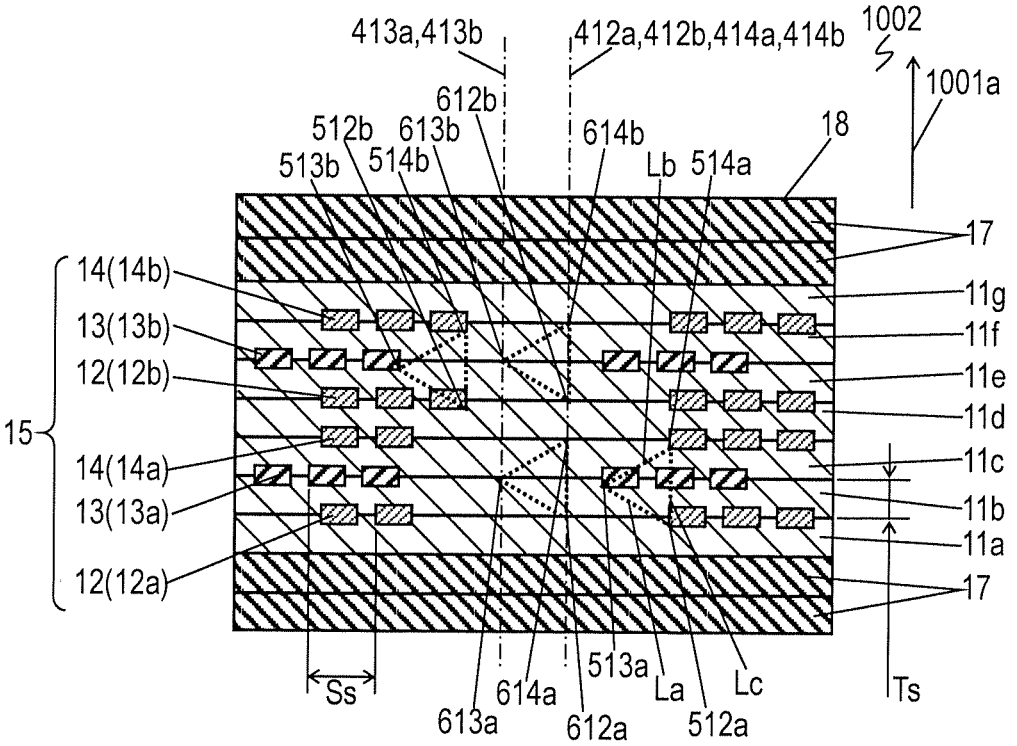
FIG. 2B is a sectional view of another common mode noise filter in accordance with Embodiment 1.

FIG. 2B is a sectional view of another common mode noise filter 1002 in accordance with Exemplary Embodiment 1. In FIG. 2B, components identical to those of common mode noise filter 1001 shown in FIG. 1A, FIG. 1B, and FIG. 2A are denoted by the same reference numerals. Common mode noise filter 1002 shown in FIG. 2B has winding axes of the coil conductors located at different positions than common mode noise filter 1001 shown in FIG. 2A. In common mode noise filter 1002 shown in FIG. 2B, winding axes 412*a*, 412*b*, 414*a*, and 414*b* of coil conductors 12*a*, 12*b*, 14*a*, and 14*b* are aligned on a single straight line, and winding axes 412*a*, 413*b*, and 414*a* of coil conductors 12*a*, 13*b*, and 14*a* are aligned on another straight line. Winding axes 412*a*, 412*b*, 414*a*, and 414*b* deviate from winding axes 412*a*, 413*b*, and 414*a* in direction Ds by deviating amount Ss. Coil conductor 14*a* and coil conductor 12*b* adjacent to each other at the center of laminate part 15 face each other substantially in laminating direction 1001*a* across non-magnetic layer 11*d*. Common mode noise filter 1002 shown in FIG. 2B provides the same effect same as common mode noise filter 1001 shown in FIG. 1A, FIG. 1B, and FIG. 2A. In the common mode noise filters in accordance with Embodiment 1, coil conductors 12*a*, 14*a*, 12*b*, and 14*b* constituting coils 12 and 14 deviate from coil conductors 13*a* and 3*b* constituting coil 13 in direction Ds perpendicular to laminating direction 1001*a* of laminate part 15, providing the same effect. More specifically, in the common mode noise filter in accordance with Embodiment 1, winding axes 412*a*, 414*a*, 412*b*, and 414*b* of coil conductors 12*a*, 14*a*, 12*b*, and 14*b* constituting coils 12 and 14 deviate from winding axes 413*a* and 413*b* of coil conductors 13*a* and 13*b* constituting coil 13 in direction Ds perpendicular to laminating direction 1001*a* of laminate part 15, providing the same effect.

In accordance with the exemplary embodiment, the inner circumference and the outer circumference of each coil conductor has substantially a rectangular shape, and the coil conductors deviate in diagonal direction Ds of the rectangular shape. The common mode noise filter in accordance with Embodiment 1 may have coil conductors deviate in either a long side direction or a short side direction of the rectangular shape. This configuration can preferably balance magnetic coupling among the coil conductors.

The shape of the main portion of each coil conductor is not necessarily a rectangular shape. The shapes of the inner circumference and outer circumference of the main portion may be a circular, oblong, or oval shape. This configuration can also balance magnetic coupling among the coil conductors.

Furthermore, coil conductors 12*a* and 12*b* shown in FIG. 1B and FIG. 2A are led out from the center of a short side of the rectangular insulating layer while coil conductors 13*a* and 13*b* are led out from a portion of the short side other than the center of the short side. Alternatively, coil conductors 13*a* and 13*b* may be led out from the center of the short side of the rectangular insulating layer while coil conductors 12*a* and 12*b* may be lead out from a portion of the short side other than the center of the short side in common mode noise filter 1001.

Exemplary Embodiment 2

Figure 3A:
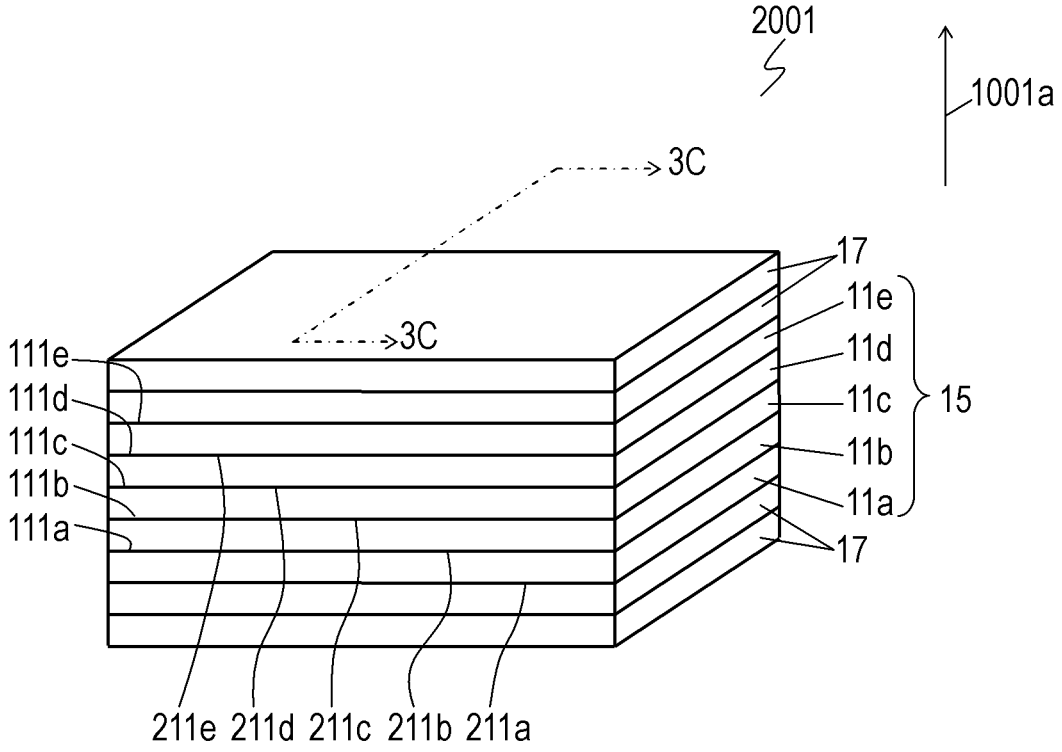
FIG. 3A is a perspective view of a common mode noise filter in accordance with Exemplary Embodiment 2.
Figure 3B:
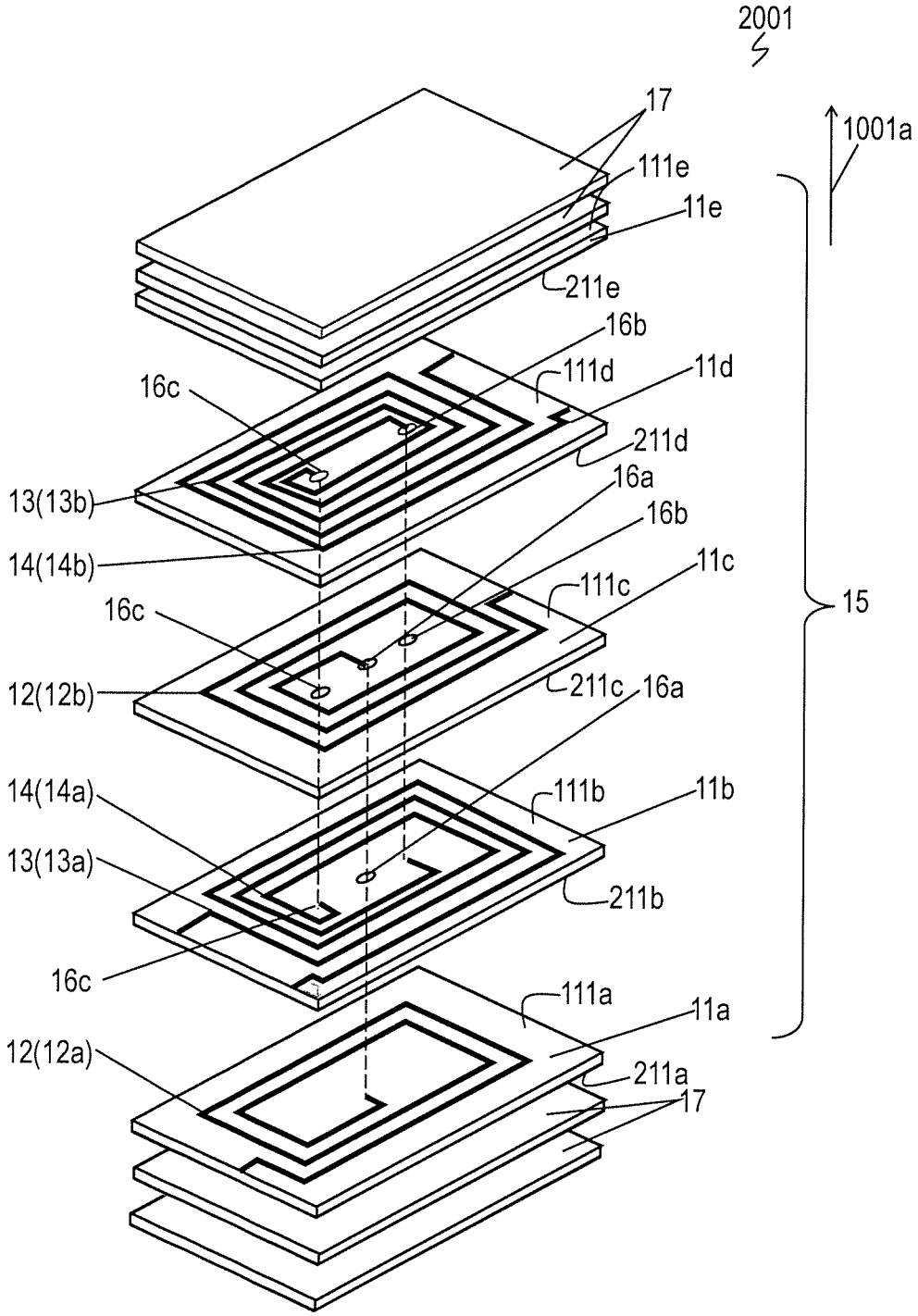
FIG. 3B is an exploded perspective view of the common mode noise filter in accordance with Embodiment 2.
Figure 3C:
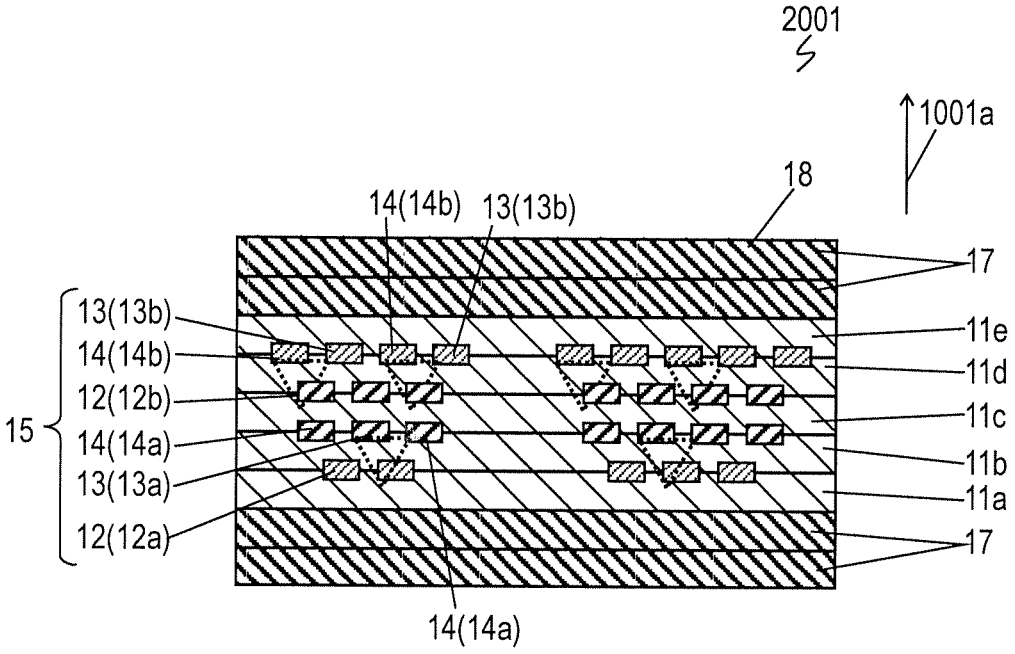
FIG. 3C is a sectional view of the common mode noise filter on line 3C-3C shown in FIG. 3A.

FIG. 3A and FIG. 3B are a perspective view and an exploded perspective view of common mode noise filter 2001 in accordance with Exemplary Embodiment 2. FIG. 3C is a sectional view of common mode noise filter 2001 on line 3C-3C shown in FIG. 3A. In FIGS. 3A to 3C, components identical to those of common mode noise filters 1001 and 1002 in accordance with Embodiment 1 are denoted by the same reference numerals.

Common mode noise filter 2001 in accordance with Embodiment 2 does not include non-magnetic layers 11*g* and 11*f* of common mode noise filters 1001 and 1002 in accordance with Embodiment 1. As shown in FIG. 3B, coil conductor 13*a* constituting coil 13 and coil conductor 14*a* constituting coil 14 are parallel to each other, and are positioned on the same plane, i.e., on upper surface 111*b* that is a surface of non-magnetic layer 11*b*. Coil conductor 13*b* constituting coil 13 and coil conductor 14*b* constituting coil 14 are parallel to each other, and are positioned on the same plane, i.e., on upper surface 111*d* that is a surface of non-magnetic layer 11*d*.

Coil conductors 13*a* and 14*a* which constitute two coils 13 and 14 and which are positioned on the same plane (upper surface 111*b*) deviate from coil conductor 12*a* constituting other coil 12 in direction Ds perpendicular to laminating direction 1001*a* of laminate part 15. Coil conductors 13*b* and 14*b* which constitute two coils 13 and 14 and which are positioned on the same plane (upper surface 111*d*) deviate from coil conductor 12*b* constituting other coil 12 in direction Ds perpendicular to laminating direction 1001*a* of laminate part 15.

A coil conductor on the same plane as coil conductors 13*a* and 13*b* constituting coil 13 may be coil conductors 12*a* and 12*b* constituting coil 12.

This structure can reduce the thickness of entire laminate part 15.

The line connecting coil conductor 12*a* and coil conductor 13*a*, the line connecting coil conductor 13*a* and coil conductor 14*a*, and the line connecting coil conductor 12*a* and coil conductor 14*a* in a cross section of laminate part 15 in laminating direction 1001*a* in portions of the coil conductors at the same order of turn from the inner circumference forms an equilateral triangle, and thereby, locate the coil conductors away from each other by the same distance. This configuration can preferably balance magnetic coupling among the coil conductors. Still more, since a distance between coil conductor 13*a* and coil conductor 14*a* is adjusted to easily adjust distances among coil conductor 13*a*, coil conductor 14*a* and coil conductor 12*a* just by adjusting the thickness of non-magnetic layer 11*b*, so that mutual magnetic coupling among coils 12, 13, and 14 can be enhanced. Still more, since a distance between coil conductor 13*b* and coil conductor 14*b* is adjusted to easily adjust distances among coil conductor 13*b*, coil conductor 14*b*, and coil conductor 12*b* just by adjusting the thickness of non-magnetic layer 11*d*, so that mutual magnetic coupling of coils 12, 13, and 14 can be enhanced. Furthermore, since a distance between coil conductor 13*b* and coil conductor 14*b* is adjusted to easily adjust distances among coil conductor 13*b*, coil conductor 14*b*, and coil conductor 12*b* just by adjusting the thickness of non-magnetic layer 11*d*, so that mutual magnetic coupling of coils 12, 13, and 14 can be enhanced.

In addition to balanced magnetic coupling, it is also important to balance capacitances among the coils since characteristic impedance in a differential mode depends on capacitances in transmission of differential signals. To adjust this capacitances, non-magnetic layer 11*e* and non-magnetic layer 11*d* may have different dielectric constants.

Exemplary Embodiment 3

Figure 4:
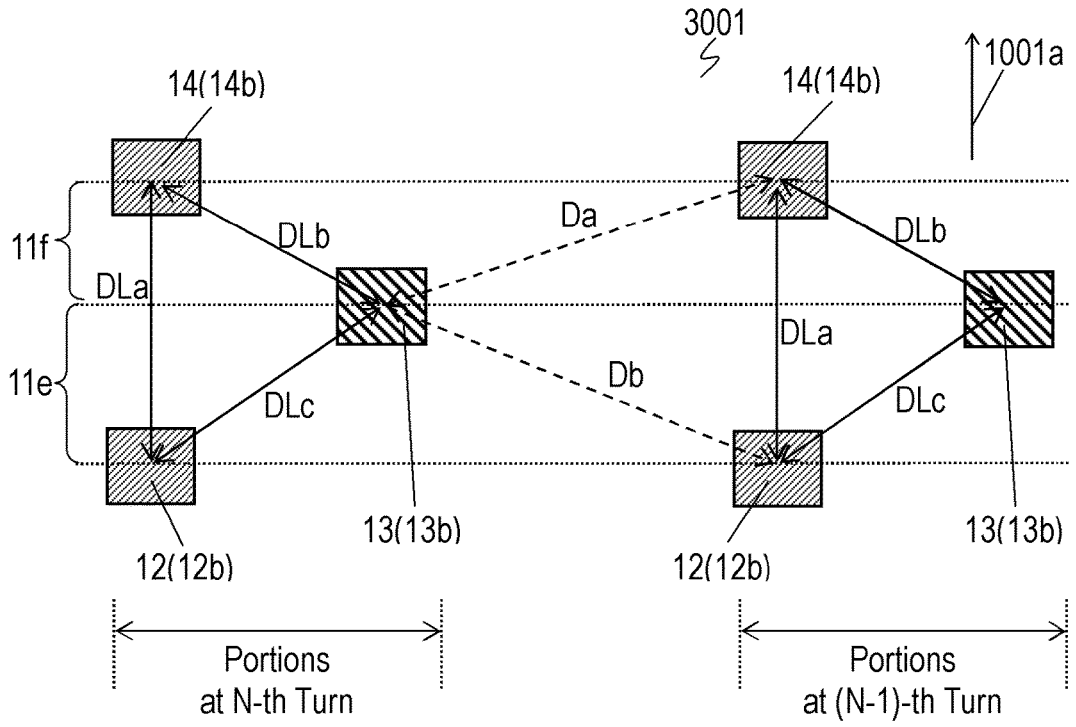
FIG. 4 is an enlarged sectional view of a common mode noise filter in accordance with Exemplary Embodiment 3.

FIG. 4 is an enlarged section view of common mode noise filter 3001 in accordance with Exemplary Embodiment 3, and illustrates a cross section of laminate part 15 in laminating direction 1001*a*. In FIG. 4, components identical to those of common mode noise filter 1001 in accordance with Embodiment 1 shown in FIGS. 1A to 2A are denoted by the same reference numerals.

As shown in FIG. 1B, main portions 312*b*, 313*b*, and 314*b* of coil conductors 12*b*, 13*b*, and 14*b* having spiral shapes have inner circumferences 212*b*, 213*b*, and 21*b*, and outer circumferences 112*b*, 113*b*, and 114*b*, respectively. As shown in FIG. 4, a portion of coil conductor 12*b* at the N-th turn from inner circumference 212*b* is apart from a portion of coil conductor 13*b* at the N-th turn from inner circumference 213*b* by distance DLc in the cross section in laminating direction 1001*a* of laminate part 15 (N is not less than zero and not greater than the number of turns of the coil conductors). The portion of coil conductor 13*b* at the N-th turn from inner circumference 213*b* is apart from a portion of coil conductor 14*b* in the N-th turn from inner circumference 214*b* by distance DLb. The portion of coil conductor 13*b* at the N-th turn from inner circumference 213*b* is apart from a portion of coil conductor 14*b* at the (N−1)-th turn from inner circumference 214*b* by distance Da. The portion of coil conductor 13*b* at the N-th turn from inner circumference 213*b* is apart from a portion of coil conductor 12*b* at the (N−1) turn from inner circumference 212*b* by distance Db. This relationship is retained while value N is an arbitrary number not less than 0 and not larger than the number of turns of each of coil conductors 12*b*, 13*b*, and 14*b*.

FIG. 4 schematically shows cross sections of coil conductor 13*b* of coil 13, and coil conductors 12*b* and 14*b* of coils 12 and 14, and illustrates two portions of coil conductors at orders of turn adjacent to each other. In other words, three wires of coil conductors 12*b*, 13*b*, and 14*b* are mutually magnetically coupled in a three-wire differential signal line. The sectional view of FIG. 4 shows a cross section of a portion of three-wire coil conductor at the N-th turn and a cross section of a portion of three-wire coil conductor at the (N−1)-th turn.

As shown in FIG. 4, coil conductor 13*b* constituting coil 13 does not overlap portions of coil conductors 12*b* and 14*b* constituting coils 12 and 14 at adjacent number of turns from the inner circumference to the outer circumference of each of the coil conductors viewing from above, i.e., viewing in laminating direction 1001*a*.

In FIG. 4, coil conductors 12*b* and 14*b* completely overlap viewing from above, i.e., viewing in laminating direction 1001*a*. However, the coil conductors may have overlapping portions viewing from above, that is, may partially overlap.

As shown in FIG. 1B, main portions 312*b*, 313*b*, and 314*b* of coil conductors 12*b*, 13*b*, and 14 having spiral shapes have inner circumferences 212*b*, 213*b*, and 214*b* and outer circumferences 112*b*, 113*b*, and 114*b*, respectively. As shown in FIG. 4, a portion of coil conductor 12*b* at the N-th turn from inner circumference 212*b* is apart from a portion of coil conductor 13*b* at the N-th turn from inner circumference 213*b* by distance DLc. The portion of coil conductor 13*b* at the N-th turn from inner circumference 213*b* is apart from a portion of coil conductor 14*b* at the N-th turn from inner circumference 214*b* by distance DLb. This relationship is retained while value N is an arbitrary number not less than zero and not greater than the number of turns of each of coil conductors 12*b*, 13*b*, and 14*b*.

In common mode noise filter 1001 in accordance with Embodiment 1, in the case that the portion of coil conductor 13*b* at the N-th turn from the inner circumference overlaps portions of coil conductors 12*b* and 14*b* at the (N−1)-th turn from the inner circumference viewing from above, i.e., viewing in laminating direction 1001*a*, undesired stray capacitance increases between the portion of coil conductor 13*b* at the N-th turn from the inner circumference and the portions of coil conductors 12*b* and 14*b* at the (N−1) turn. When a differential signal is input, the differential signal may degrade in a high-frequency range that tends to be affected by stray capacitance.

In common mode noise filter 3001 in accordance with Embodiment 3, the portion of coil conductor at the N-th turn does not overlap the portion of the coil conductor at the (N−1)-th turn viewing from above, i.e., viewing in laminating direction 1001*a*. Accordingly, undesired stray capacitance is reduced, thus reducing degradation of differential signals.

As shown in FIG. 4, each of distances Da and Db between a portion of coil conductor 13*b* constituting coil 13 at a certain order of turn and respective one of portions of coil conductors 12*b* and 4*b* constituting coils 12 and 14 at an order of turn adjacent to the certain order of turn from the inner circumference to the outer circumference of each coil conductor are longer than distances DLa, DLb, and DLc between coil conductors 12*b*, 13*b*, and 14*b* constituting coils 12, 13, and 14.

In a three-wire differential signal line, undesired stray capacity between coil conductor 13*b* and portions of coil conductors 12*b* and 14*b* in the adjacent order of turn increases if distances Da and Db between a portion of coil conductors 12*b* and 14*b* at the N-th turn a portions of coil conductors 12*b* and 14*b* at the N-th turn are not longer than distances DLa, DLb, and DLc in the portion of coil conductor in the N-th turn and the portion of coil conductor in the (N−1) turn shown in FIG. 4. Accordingly, characteristic impedance in a differential mode between differential lines of coil conductor 13*b* and coil conductor 12*b* and characteristic impedance in the differential mode between differential lines of coil conductor 13*b* and coil conductor 14*b* become lower than characteristic impedance in the differential mode between coil conductor 13*b* and coil conductor 14*b*. This configuration loses the balance among three wires, and may degrade the differential signals.

On the other hand, in common mode noise filter 3001 in accordance with Embodiment 3, distances Da and Db are longer than distances DLa, DLb, and DLc so that undesired stray capacitance between a portion of coil conductor 13*b* at a certain order of turn and each of portions of coil conductors 12*b* and 14*b* at an order of turn adjacent to the certain order of turn of coil conductor 13*b* can be further reduced.

Figure 5:
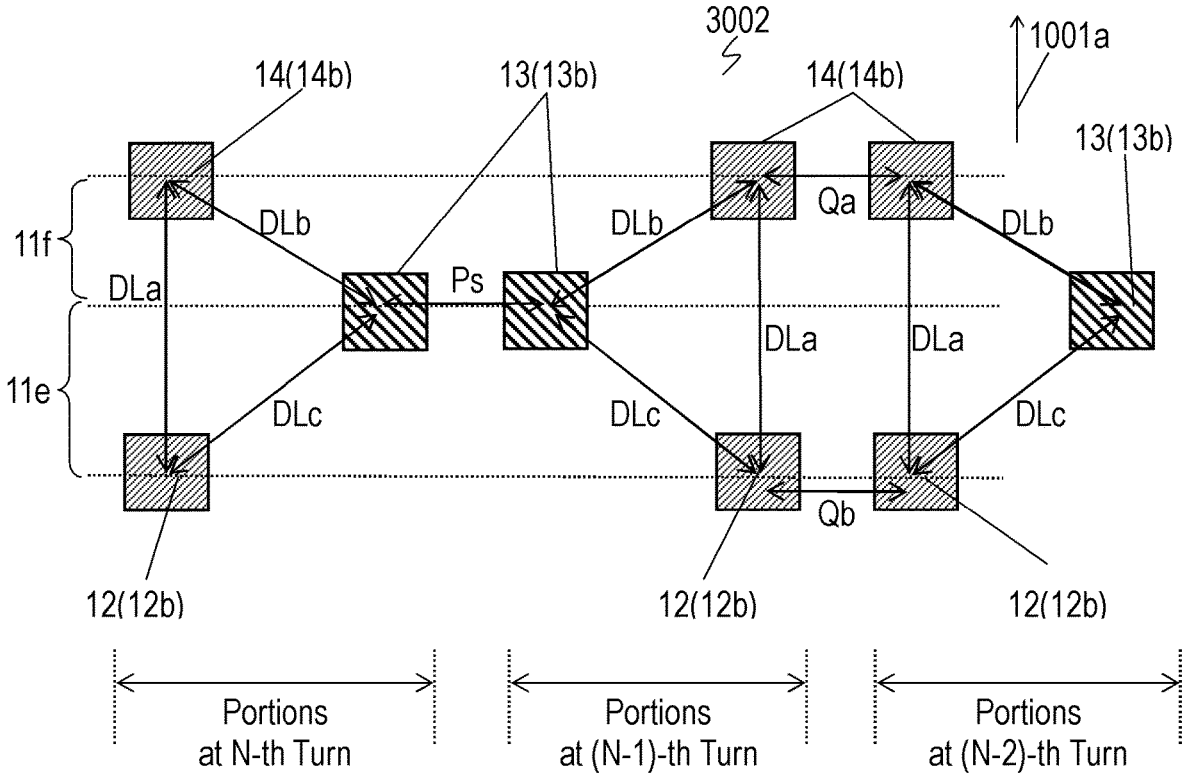
FIG. 5 is an enlarged sectional view of another common mode noise filter in accordance with Embodiment 3.

FIG. 5 is an enlarged sectional view of another common mode noise filter 3002 in accordance with Embodiment 3. In FIG. 5, components identical to those of common mode noise filter 3001 shown in FIG. 4 are denoted by the same reference numerals. In common mode noise filter 3002 shown in FIG. 5, regarding portions of the coil conductors 12*b*, 13*b*, and 14*b* at the N-th turn from the inner circumferences, portions of the coil conductors at the (N−1)-th turn from the inner circumferences, and portions of the coil conductors at the (N−2)-th turn, portions of coil conductor 13*b* at orders of turn adjacent to each other are positioned between portions of coil conductors 12*b* and 14*b* at the orders of turn adjacent to each other. This configuration can reduce undesired stray capacitance between coil conductor 13*b* and each of portions of coil conductors 12*b* and 14*b* at the orders of turn adjacent to coil conductor 13*b*.

Since two portions of coil conductor 13*b* have the same potential, no large undesired stray capacitance is generated between these portions. Still more, the above two portions of coil conductor 13*b* are positioned between portions of each of coil conductors 12*b* and 14*b* at the orders of turn adjacent to each other. This configuration provides a long distance between a portion of coil conductor 13*b* at a certain order of turn and each of portions of coil conductors 12*b* and 4*b* at an order of turn adjacent to the certain order of turn. This configuration reduces undesired stray capacitance between the above portion of coil conductor 13*b* and each of the portions of coil conductors 12*b* and 14*b*. Similarly, an undesired stray capacitance between each of two portions of coil conductor 12*b* and each of two portions of coil conductor 14*b* can be reduced by arranging a portion of the coil conductors at the (N−2)-th turn, as shown in FIG. 5. This configuration can prevent degradation of differential signals.

Still more, as shown in FIG. 5, distance Ps between two portions of conductor 13*b* at adjacent orders of turn, distance Qb between two portions of coil conductor 12*b*, and distance Qa between two portions of coil conductor 14*b* can be narrow since there is no need to consider insulation. Accordingly, an area where coil conductor is formed viewing from above, i.e., viewing in laminating direction 1001*a*, can be reduced by making distances Ps, Qb, and Qa shorter than distances DLa, DLb, and DLc between the coil conductors. Accordingly, the coil conductors can be wound more on the same plane.

Positions of coil conductors 12*b*, 13*b*, and 14*b* of coils 12, 13, and 14 are explained above. Other coil conductors 12*a*, 13*a*, and 14*a* or coils 12, 13, and 14 can be disposed similarly to coil conductors 12*b*, 13*b*, and 14*b*, respectively.

This configuration reduces undesired stray capacitance between a portion of coil conductor 13*b* at a certain order of turn and each of portions of coil conductors 12*b* and 14*b* at an order of turn adjacent to the certain order so as to prevent degradation of differential signals. At the same time, more number of windings increases impedance and improves noise elimination performance when a common mode noise is input.

Exemplary Embodiment 4

Figure 6:
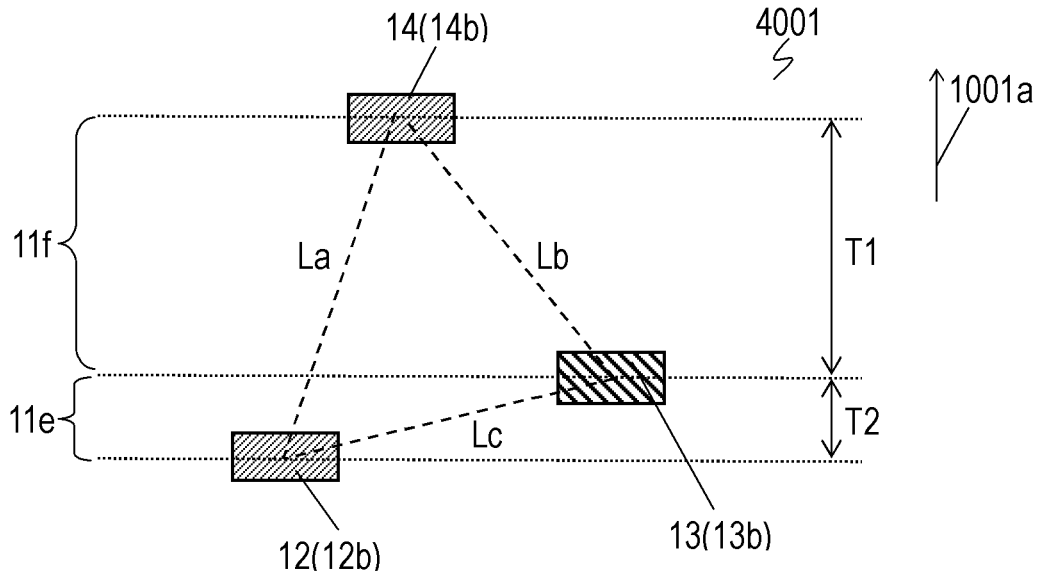
FIG. 6 is a sectional view of a main portion of a common mode noise filter in accordance with Exemplary Embodiment 4.

FIG. 6 is an exploded perspective view of common mode noise filter 4001 in accordance with Exemplary Embodiment 4. In FIG. 6, components identical to those of common mode noise filter 1001 in accordance with Embodiment 1 shown in FIGS. 1A to 2A are denoted by the same reference numerals.

In common mode noise filter 4001 in accordance with Embodiment 4, as shown in FIG. 6, an arbitrary coil conductor out of coil conductors 12*a*, 12*b*, 13*a*, 13*b*, 14*a*, and 14*b* does not overlap other coil conductors viewing from above, i.e., viewing in laminating direction 1001*a*.

FIG. 6 schematically illustrates cross sections of coil conductor 13*b* of coil 13 and coil conductors 12*b* and 14*b* of coils 12 and 14. Coil conductors formed by a printing process often have a thickness in laminating direction 1001*a* smaller than a line width that is a width in a direction perpendicular to laminating direction 1001*a* and direction Lk (see FIG. 1B) in which the coil conductor extends. Thicknesses of coil conductors 12*b*, 13*b*, and 14*b* are smaller than the line width in common mode noise filter 4001 shown in FIG. 6.

Distance T1 between coil conductor 12*b* and coil conductor 13*b* (thickness of non-magnetic layer 110 in laminating direction 1001*a* is longer than distance T2 between coil conductor 13*b* and coil conductor 14*b* (thickness of non-magnetic layer 11*e*) in laminating direction 1001*a* in order to form an equilateral triangle with line La connecting coil conductor 12*b* constituting coil 12 to coil conductor 13*b* constituting coil 13, line Lb connecting coil conductor 13*b* constituting coil 13 to coil conductor 14*b* constituting coil 14, and line Lc connecting coil conductor 12*b* constituting coil 12 to coil conductor 14*b* constituting coil 14. This structure balances magnetic coupling among coils.

If the thickness of the coil conductor is smaller than the line width thereof, capacitance between portions of coil conductor 12*b* and coil conductor 14*b* facing and overlapping each other viewing from above becomes larger than a capacitance between coil conductor 12*b* and coil conductor 13*b* or a capacitance between coil conductor 14*b* and coil conductor 13*b* with a small opposing area in common mode noise filter 3001 in accordance with Embodiment 3. In common mode noise filter 4001 in accordance with Embodiment 4, the capacitances among the coil conductors can be balanced since coil conductor 12*b*, coil conductor 14*b*, and coil conductor 13*b* do not overlap one another viewing from above, hence preventing degradation of differential signals.

In FIG. 6, distance T2 is smaller than distance T1, but non-magnetic layers 11*e* and 11*f* forming distances T1 and T2 may have different dielectric constant, so as to adjust the capacitances.

Exemplary Embodiment 5

Figure 7:
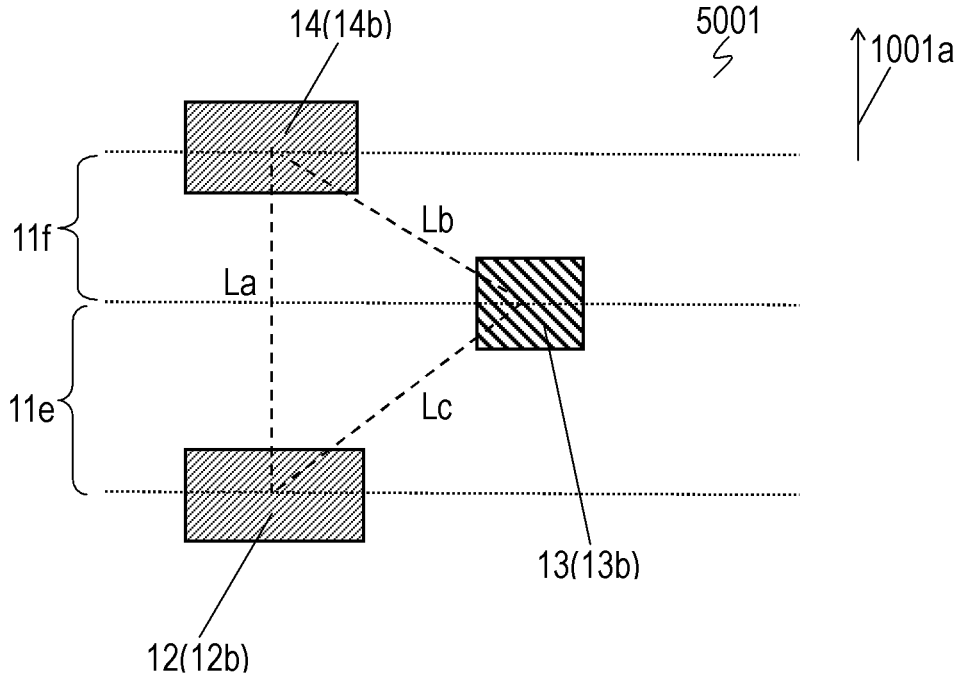
FIG. 7 is a sectional view of a main portion of a common mode noise filter in accordance with Exemplary Embodiment 5.

FIG. 7 is a sectional view of common mode noise filter 5001 in accordance with Exemplary Embodiment 5. In FIG. 7, components identical to those of common mode noise filter 1001 in accordance with Embodiment 1 shown in FIGS. 1A to 2A are denoted by the same reference numerals.

In common mode noise filter 5001 in accordance with Embodiment 5, as shown in FIG. 7, coil conductors 12*b* and 14*b* constituting coils 12 and 14 face each other in laminating direction 1001*a*. Line widths of coil conductors 12*b* and 14*b* facing each other are wider than a line width of other coil conductor 13*b*.

FIG. 7 schematically illustrates cross sections of coil conductor 13*b* of coil 13, and coil conductors 12*b* and 14*b* of coils 12 and 14.

If the thickness of non-magnetic layer has a lower limit in view of production basis, a residual inductance is generated without completely cancelling magnetic flux generated in coil conductors 12*b* and 14*b* due to reduced electrostatic capacitance and slightly weakened magnetic coupling between coil conductors 12*b* and 14*b* facing each other. Accordingly, characteristic impedance in the differential mode increases when the differential signal flows between opposing coil conductors 12*b* and 14*b*. This may generate a reflection loss of differential signals and degrade differential signals. To reduce characteristic impedance in the differential mode, a capacitance between coil conductors 12*b* and 14*b* facing each other is adjusted to be slightly larger and line widths of coil conductors 12*b* and 14*b* be broader to increase the capacitance. This obtains consistency of characteristic impedance in the differential mode. Accordingly, signal degradation can be prevented.

Figure 8:
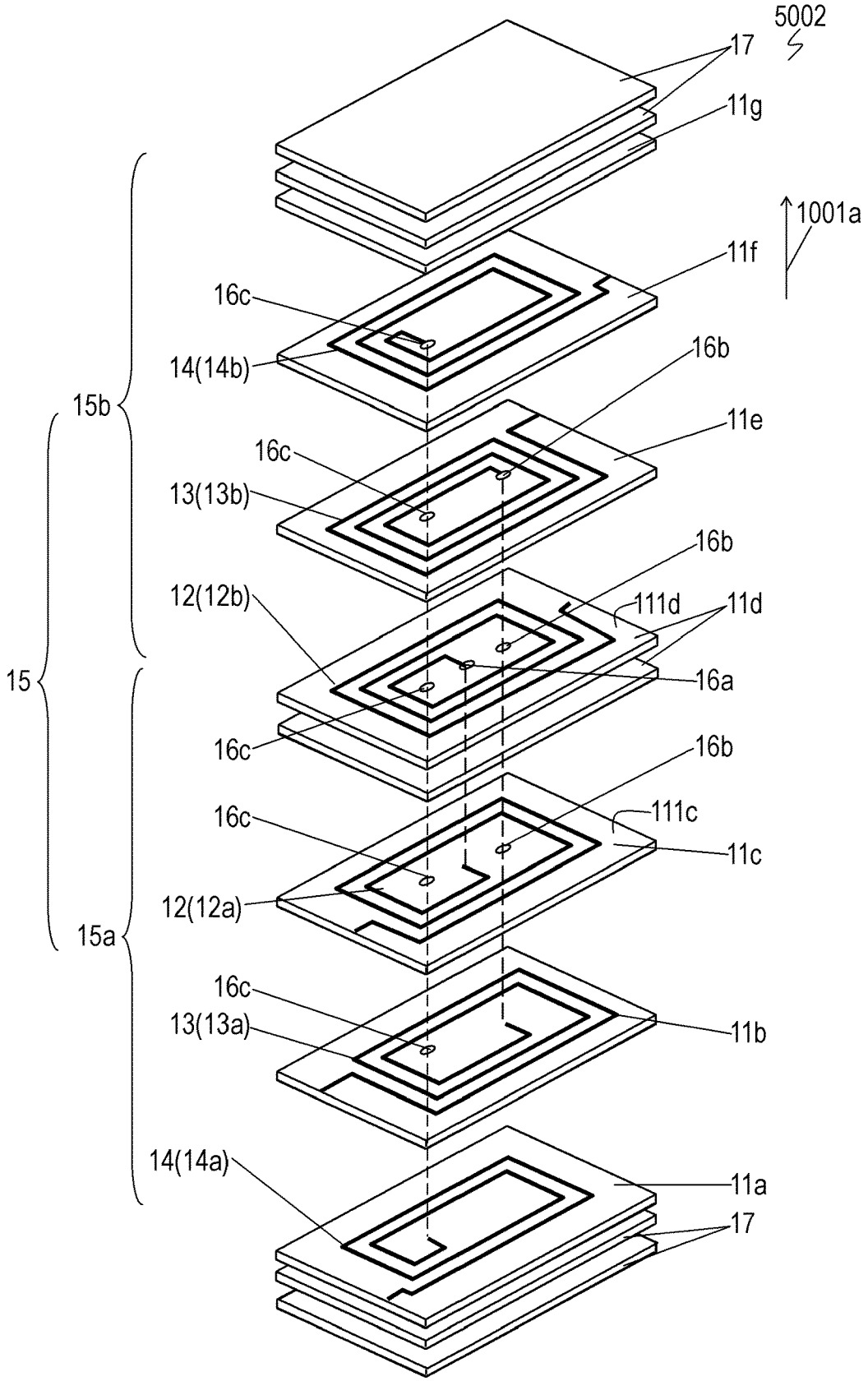
FIG. 8 is an exploded perspective view of another common mode noise filter in accordance with Embodiment 5.

FIG. 8 is an exploded perspective view of another common mode noise filter 5002 in accordance with Embodiment 5. In FIG. 8, components identical to those of common mode noise filter 1001 in accordance with Embodiment 1 shown in FIGS. 1A to 2A are denoted by the same reference numerals. In common mode noise filter 5002 shown in FIG. 8, laminate part 15 includes laminate parts 15*a* and 15*b* stacked in laminating direction 1001*a*. Laminate part 15*a* includes non-magnetic layers 11*a* to 11*d*, coil conductor 12*a* constituting coil 12, coil conductor 13*a* constituting coil 13, and coil conductor 14*a* constituting coil 14. Laminate part 15*b* includes non-magnetic layers 11*d* to 11*f*, coil conductor 12*b* constituting coil 12, coil conductor 13*b* constituting coil 13, and coil conductor 14*b* constituting coil 14. Unlike common mode noise filter 1001 in accordance with Embodiment 1 shown in FIG. 1B, coil conductor 12*a* is provided on upper surface 111*c* of non-magnetic layer 11*c* and coil conductor 14*a* is provided on upper surface 111*a* of non-magnetic layer 11*a* in common mode noise filter 5002 shown in FIG. 8. Two non-magnetic layers 11*d* are provided between coil conductors 12*a* and 12*b*. Non-magnetic layer 11*d* of laminate part 15*a* is placed on non-magnetic layer 11*d* of laminate part 15*b* to constitute laminate part 15. As shown in FIG. 8, a distance between laminate part 15*a* and coil conductors 12*a* and 12*b* closest to laminate part 15*b* may be larger than a distance between other coil conductors 12*a* and 13*a*, a distance between coil conductors 13*a* and 14*a*, a distance between coil conductors 12*a* and 14*a*, a distance between coil conductors 12*b* and 13*b*, a distance between coil conductors 13*b* and 14*b*, and a distance between coil conductors 12*b* and 14*b*.

Still more, as shown in FIG. 8, the laminating order of coil conductor 12*a* constituting coil 12, coil conductor 13*a* constituting coil 13, and coil conductor 14*a* constituting coil 14 in laminate part 15*a* is opposite to the laminating order of coil conductor 12*b* constituting coil 12, coil conductor 13*b* constituting coil 13, and coil conductor 14*b* constituting coil 14.

In FIG. 8, laminate part 15*a* includes coil conductor 14*a* constituting coil 14, coil conductor 13*a* constituting coil 13, and coil conductor 12*a* constituting coil 12 in this order from below. Conversely, laminate part 15*b* includes coil conductor 12*b* constituting coil 12, coil conductor 13*b* constituting coil 13, and coil conductor 14*b* constituting coil 14 in this order from below.

In the structure shown in FIG. 8, coil conductor 12*a* and coil conductor 12*b* located closest to each other and facing each other have the same potential, and thus stray capacitance hardly affects the characteristic between coil conductors 12*a* and 12*b*. This can prevent reduction of characteristic impedance, and thus degradation of the quality of differential signals can be suppressed.

As described above, non-magnetic layers 11*a* to 11*f* and coils 12, 13, and 14 constitute laminate part 15*a* and laminate part 15*b* placed on laminate part 15*a* in laminating direction 1001*a*. Laminate part 15*a* includes coil conductors 12*a* to 14*a* and non-magnetic layers 11*a* to 11*d* out of non-magnetic layers 11*a* to 11*f*. Laminate part 15*b* includes coil conductors 12*b* to 14*b* and non-magnetic layers 11*d* to 11*d* in non-magnetic layers 11*a* to 11*f*. A distance between coil conductor 12*a* out of coil conductors 12*a* to 14*a* which is closest to laminate part 15*b* and coil conductor 12*b* out of coil conductors 12*b* to 14*b* which is closest to laminate part

15*a* is longer than a distance between coil conductors 12*a* and 13*a*, a distance between coil conductors 13*a* and 14*a*, a distance between coil conductors 12*a* and 14*a*, a distance between coil conductors 12*b* and 13*b*, a distance between coil conductors 13*b* and 14*b*, and a distance between coil conductors 12*b* and 14*b*.

Furthermore, coil conductors 12*a* to 14*a* and 12*b* to 14*b* are disposed in the order of coil conductor 14*a*, coil conductor 13*a*, coil conductor 12*a*, coil conductor 12*b*, coil conductor 13*b*, and coil conductor 14*b* in laminating direction 1001*a*.

In the embodiments, terms, such as "upper surface" and "lower surface", indicating directions indicate relative positions determined only by relative positional relationship of components, such as non-magnetic layers and coil conductors, of the common mode noise filter, and do not indicate absolute directions, such as a vertical direction.

INDUSTRIAL APPLICABILITY

A common mode noise filter according to the present invention can be employed in three-wire differential lines. Balanced magnetic coupling can be achieved among three coils, quality of differential signals can be maintained, and common mode noise can be eliminated. In particular, it is effectively applicable to small and thin common mode noise filters used typically in digital equipment, AV equipment, and information communication terminals.

REFERENCE MARKS IN THE DRAWINGS

11*a*-11*g* non-magnetic layer
coil (first coil)
12*a* coil conductor (first coil conductor)
12*b* coil conductor (first coil conductor, fourth coil conductor)
13 coil (second coil)
13*a* coil conductor (second coil conductor)
13*b* coil conductor (second coil conductor, fifth coil conductor)
14 coil (third coil)
14*a* coil conductor (third coil conductor)
14*b* coil conductor (third coil conductor, sixth coil conductor)
15 laminate part
15*a* laminate part (first laminate part)
15*b* laminate part (second laminate part)
16*a*, 16*b*, 16*c* via electrode
17 magnetic layer
18 laminate body
112*b* inner circumference (first inner circumference)
113*b* inner circumference (second inner circumference)
114*b* inner circumference (third inner circumference)
212*b* outer circumference (first outer circumference)
213*b* outer circumference (second outer circumference)
214*b* outer circumference (third outer circumference)
312*b* main portion (first main portion)
313*b* main portion (second main portion)
314*b* main portion (third main portion)
DLa distance (third distance)
DLb distance (second distance)
DLc distance (first distance)

The invention claimed is:

1. A common mode noise filter comprising:

a plurality of non-magnetic layers stacked in a laminating direction; and first, second, and third coils independent from each other and formed on the plurality of non-magnetic layers, wherein the first, second, and third coils include first, second, and third coil conductors, respectively, wherein the first coil conductor includes a first main portion having a spiral shape having one or more turns extending from a first inner circumference to a first outer circumference, wherein the second coil conductor includes a second main portion having a spiral shape having one or more turns extending from a second inner circumference to a second outer circumference, wherein the third coil conductor includes a third main portion having a spiral shape having one or more turns extending from a third inner circumference to a third outer circumference, wherein the first and third coil conductors deviate from the second coil conductor in a direction perpendicular to the laminating direction, and wherein, viewing in the laminating direction, respective portions of the first and third coil conductors at a same order of turn from the first and third inner circumferences toward the first and third outer circumferences do not overlap a portion of the second coil conductor at the same order of turn from the second inner circumference toward the second outer circumference.

2. The common mode noise filter of claim 1, wherein the second coil conductor is positioned on a same plane as the first coil conductor on a surface of a non-magnetic layer out of the plurality of non-magnetic layers.

3. The common mode noise filter of claim 1, wherein a portion of the first coil conductor at an N-th turn from the first inner circumference is apart from a portion of the second coil conductor at an N-th turn from the second inner circumference by a first distance, where N is a number not less than zero and not greater than a number of turns of the first coil conductor, wherein the portion of the second coil conductor at the N-th turn from the second inner circumference is apart from a portion of the third coil conductor in an N-th turn from the third inner circumference by a second distance, wherein the portion of the first coil conductor at the N-th turn from the first inner circumference is apart from the portion of the third coil conductor at the N-th turn from the third inner circumference by a third distance, and wherein a distance between the portion of the second coil conductor at the N-th turn from the second inner circumference and a portion of the first coil conductor at an (N−1)-th turn from the first inner circumference and a distance between the portion of the second coil conductor at the N-th turn from the second inner circumference and a portion of the third coil conductor at an (N−1)-th turn from the third inner circumference are longer than the first distance, the second distance, and the third distance.

4. The common mode noise filter of claim 1, wherein a portion of the second coil conductor at an N-th turn from the second inner circumference and a portion of the second coil conductor at an (N−1)-th turn from the second inner circumference are positioned between a portion of the first coil conductor at an N-th turn from the first inner circumference and a portion of the first coil conductor at an (N−1)-th turn from the first inner circumference, and are also positioned between a portion of the third coil conductor at an N-th turn from the third inner circumference and a portion of the third coil conductor at an (N−1)-th turn from the third inner circumference, where N is a number not less than 0 and not greater than a number of turns of the first coil conductor.

5. The common mode noise filter of claim 4, wherein the portion of the first coil conductor at the (N−1)-th turn from the first inner circumference, the portion of the third coil conductor at the (N−1)-th turn from the third inner circumference, a portion of the first coil conductor at an (N−2)-th turn from the first inner circumference, and a portion of the third coil conductor at an (N−2)-th turn from the third inner circumference are positioned between the portion of the second coil conductor at the (N−1)-th turn from the second inner circumference and a portion of the second coil conductor at an (N−2)-th turn from the second inner circumference.

6. The common mode noise filter of claim 4, wherein the portion of the first coil conductor at the N-th turn from the first inner circumference is apart from the portion of the second coil conductor at the N-th turn from the second inner circumference by a first distance, wherein the portion of the second coil conductor at the N-th turn from the second inner circumference is apart from the portion of the third coil conductor at the N-th turn from the third inner circumference by a second distance, wherein the portion of the first coil conductor at the N-th turn from the first inner circumference is apart from the portion of the third coil conductor at the N-th turn from the third inner circumference by a third distance, and wherein a distance between the portion of the second coil conductor at the N-th turn from the second inner circumference and a portion of the second coil conductor at an (N−1)-th turn from the second inner circumference are shorter than the first distance, the second distance, and the third distance.

7. The common mode noise filter of claim 1, wherein portions of the first, second, and third coil conductors at the same order of turn from the first, second, and third inner circumferences form three vertexes of an equilateral triangle in a cross section of the plurality of non-magnetic layers and the first, second, and third coil conductors in the laminating direction.

8. The common mode noise filter of claim 1, wherein the first, second, and third coil conductors do not overlap each other viewing in the laminating direction.

9. The common mode noise filter of claim 1, wherein the first coil conductor faces the third coil conductor in the laminating direction, and wherein line widths of the first and third coil conductors are larger than a line width of the second coil conductor.

10. The common mode noise filter of claim 9, wherein a portion of the first coil conductor at an N-th turn from the first inner circumference is apart from a portion of the second coil conductor at an N-th turn from the second inner circumference by a first distance, wherein the portion of the second coil conductor at the N-th turn from the second inner circumference is apart from a portion of the third coil conductor at an N-th turn from the third inner circumference by a second distance, wherein the portion of the first coil conductor at the N-th turn from the first inner circumference is apart from the portion of the third coil conductor at the N-th turn from the third inner circumference by a third distance, and wherein the third distance is longer than the first distance and the second distance.

11. The common mode noise filter of claim 1, wherein the first, second and third coils further include fourth, fifth, and sixth coil conductors, respectively, wherein the plurality of non-magnetic layers and the first, second, and third coils constitute:

a first laminate part including the first, second, and third coil conductors and a plurality of first non-magnetic layers out of the plurality of non-magnetic layers; and a second laminate part provided on the first laminate part in the laminating direction, the second laminate part including the fourth, fifth, and sixth coil conductors and a plurality of second non-magnetic layers out of the plurality of non-magnetic layers, and wherein a distance between a coil conductor closest to the second laminate part among the first, second, and third coil conductors and a coil conductor closest to the first laminate part among the fourth, fifth, and sixth coil conductors is longer than a distance between the first and second coil conductors, a distance between the second and third coil conductors, a distance between the first and third coil conductors, a distance between the fourth and fifth coil conductors, a distance between the fifth and sixth coil conductors, and a distance between the fourth and sixth coil conductors.

12. The common mode noise filter of claim 1, wherein the first, second, and third coils further include fourth, fifth, and sixth coil conductors, respectively, wherein the plurality of non-magnetic layers and the first, second, and third coils constitute:

a first laminate part including the first, second, and third coil conductors and a plurality of first non-magnetic layers out of the plurality of non-magnetic layers; and a second laminate part on the first laminate part in the laminating direction, the second laminate part including the fourth, fifth, and sixth coil conductors and a plurality of second non-magnetic layers out of the plurality of non-magnetic layers, and wherein the first to sixth coil conductors are disposed such that the third coil conductor, the second coil conductor, the first coil conductor, the fourth coil conductor, the fifth coil conductor, and the sixth coil conductor are stacked in this order in the laminating direction.

13. The common mode noise filter of claim 1, wherein the first, second and third main portions of the first, second, and third coil conductors includes conductor patterns having shapes identical to one another.

14. The common mode noise filter of claim 2, wherein the third coil conductor is positioned between the first coil conductor and the second coil conductor viewing in the laminating direction.

15. A common mode noise filter comprising:

a plurality of non-magnetic layers stacked in a laminating direction; and first, second, and third coils independent from each other and formed on the plurality of non-magnetic layers, wherein the first, second, and third coils are wound about first, second, and third winding axes, respectively, wherein the first, second, and third coils include first, second, and third coil conductors, respectively, wherein the first coil conductor includes a first main portion having a spiral shape having one or more turns extending from a first inner circumference to a first outer circumference, wherein the second coil conductor includes a second main portion having a spiral shape having one or more turns extending from a second inner circumference to a second outer circumference, wherein the third coil conductor includes a third main portion having a spiral shape having one or more turns extending from a third inner circumference to a third outer circumference, wherein the first and third coil conductors deviate from the second coil conductor in a direction perpendicular to the laminating direction, and wherein the first and third winding axes deviate from the second winding axis in the direction perpendicular to the laminating direction.

16. The common mode noise filter of claim 15, wherein the second coil conductor is positioned on a same plane as the first coil conductor on a surface of a non-magnetic layer out of the plurality of non-magnetic layers.

17. The common mode noise filter of claim 16, wherein the third coil conductor is positioned between the first coil conductor and the second coil conductor viewing in the laminating direction.

18. The common mode noise filter of claim 15, wherein a portion of the first coil conductor at an N-th turn from the first inner circumference is apart from a portion of the second coil conductor at an N-th turn from the second inner circumference by a first distance, where N is a number not less than zero and not greater than a number of turns of the first coil conductor, wherein the portion of the second coil conductor at the N-th turn from the second inner circumference is apart from a portion of the third coil conductor in an N-th turn from the third inner circumference by a second distance, wherein the portion of the first coil conductor at the N-th turn from the first inner circumference is apart from the portion of the third coil conductor at the N-th turn from the third inner circumference by a third distance, and wherein a distance between the portion of the second coil conductor at the N-th turn from the second inner circumference and a portion of the first coil conductor at an (N−1)-th turn from the first inner circumference and a distance between the portion of the second coil conductor at the N-th turn from the second inner circumference and a portion of the third coil conductor at an (N−1)-th turn from the third inner circumference are longer than the first distance, the second distance, and the third distance.

19. The common mode noise filter of claim 15, wherein a portion of the second coil conductor at an N-th turn from the second inner circumference and a portion of the second coil conductor at an (N−1)-th turn from the second inner circumference are positioned between a portion of the first coil conductor at an N-th turn from the first inner circumference and a portion of the first coil conductor at an (N−1)-th turn from the first inner circumference, and are also positioned between a portion of the third coil conductor at an N-th turn from the third inner circumference and a portion of the third coil conductor at an (N−1)-th turn from the third inner circumference, where N is a number not less than 0 and not greater than a number of turns of the first coil conductor.

20. The common mode noise filter of claim 19, wherein the portion of the first coil conductor at the (N−1)-th turn from the first inner circumference, the portion of the third coil conductor at the (N−1)-th turn from the third inner circumference, a portion of the first coil conductor at an (N−2)-th turn from the first inner circumference, and a portion of the third coil conductor at an (N−2)-th turn from the third inner circumference are positioned between the portion of the second coil conductor at the (N−1)-th turn from the second inner circumference and a portion of the second coil conductor at an (N−2)-th turn from the second inner circumference.

21. The common mode noise filter of claim 19, wherein the portion of the first coil conductor at the N-th turn from the first inner circumference is apart from the portion of the second coil conductor at the N-th turn from the second inner circumference by a first distance, wherein the portion of the second coil conductor at the N-th turn from the second inner circumference is apart from the portion of the third coil conductor at the N-th turn from the third inner circumference by a second distance, wherein the portion of the first coil conductor at the N-th turn from the first inner circumference is apart from the portion of the third coil conductor at the N-th turn from the third inner circumference by a third distance, and wherein a distance between the portion of the second coil conductor at the N-th turn from the second inner circumference and a portion of the second coil conductor at an (N−1)-th turn from the second inner circumference are shorter than the first distance, the second distance, and the third distance.

22. The common mode noise filter of claim 15, wherein portions of the first, second, and third coil conductors at the same order of turn from the first, second, and third inner circumferences form three vertexes of an equilateral triangle in a cross section of the plurality of non-magnetic layers and the first, second, and third coil conductors in the laminating direction.

23. The common mode noise filter of claim 15, wherein the first, second, and third coil conductors do not overlap each other viewing in the laminating direction.

24. The common mode noise filter of claim 15, wherein the first coil conductor faces the third coil conductor in the laminating direction, and wherein line widths of the first and third coil conductors are larger than a line width of the second coil conductor.

25. The common mode noise filter of claim 24, wherein a portion of the first coil conductor at an N-th turn from the first inner circumference is apart from a portion of the second coil conductor at an N-th turn from the second inner circumference by a first distance, wherein the portion of the second coil conductor at the N-th turn from the second inner circumference is apart from a portion of the third coil conductor at an N-th turn from the third inner circumference by a second distance, wherein the portion of the first coil conductor at the N-th turn from the first inner circumference is apart from the portion of the third coil conductor at the N-th turn from the third inner circumference by a third distance, and wherein the third distance is longer than the first distance and the second distance.

26. The common mode noise filter of claim 15, wherein the first, second and third coils further include fourth, fifth, and sixth coil conductors, respectively, wherein the plurality of non-magnetic layers and the first, second, and third coils constitute:

a first laminate part including the first, second, and third coil conductors and a plurality of first non-magnetic layers out of the plurality of non-magnetic layers; and a second laminate part provided on the first laminate part in the laminating direction, the second laminate part including the fourth, fifth, and sixth coil conductors and a plurality of second non-magnetic layers out of the plurality of non-magnetic layers, and wherein a distance between a coil conductor closest to the second laminate part among the first, second, and third coil conductors and a coil conductor closest to the first laminate part among the fourth, fifth, and sixth coil conductors is longer than a distance between the first and second coil conductors, a distance between the second and third coil conductors, a distance between the first and third coil conductors, a distance between the fourth and fifth coil conductors, a distance between the fifth and sixth coil conductors, and a distance between the fourth and sixth coil conductors.

27. The common mode noise filter of claim 15, wherein the first, second, and third coils further include fourth, fifth, and sixth coil conductors, respectively, wherein the plurality of non-magnetic layers and the first, second, and third coils constitute:

a first laminate part including the first, second, and third coil conductors and a plurality of first non-magnetic layers out of the plurality of non-magnetic layers; and a second laminate part on the first laminate part in the laminating direction, the second laminate part including the fourth, fifth, and sixth coil conductors and a plurality of second non-magnetic layers out of the plurality of non-magnetic layers, and wherein the first to sixth coil conductors are disposed such that the third coil conductor, the second coil conductor, the first coil conductor, the fourth coil conductor, the fifth coil conductor, and the sixth coil conductor are stacked in this order in the laminating direction.

28. The common mode noise filter of claim 15, wherein the first, second and third main portions of the first, second, and third coil conductors includes conductor patterns having shapes identical to one another.

29. A common mode noise filter comprising:

a plurality of non-magnetic layers stacked in a laminating direction; and first, second, and third coils independent from each other and formed on the plurality of non-magnetic layers, wherein the first, second, and third coils include first, second, and third coil conductors, respectively, wherein the first coil conductor includes a first main portion having a spiral shape having one or more turns extending from a first inner circumference to a first outer circumference, wherein the second coil conductor includes a second main portion having a spiral shape having one or more turns extending from a second inner circumference to a second outer circumference, wherein the third coil conductor includes a third main portion having a spiral shape having one or more turns extending from a third inner circumference to a third outer circumference, wherein the first and third coil conductors deviate from the second coil conductor in a direction perpendicular to the laminating direction, wherein the second coil conductor is positioned on a same plane as the third coil conductor on a surface of a non-magnetic layer out of the plurality of non-magnetic layers, and wherein, viewing in the laminating direction, a portion of the first coil conductor at a same order of turn from the first inner circumference toward the first outer circumference is positioned between a portion of the third coil conductor at the same order of turn from the third inner circumference toward the third outer circumference and a portion of the second coil conductor at the same order of turn from the second inner circumference toward the second outer circumference.

30. A common mode noise filter comprising:

a plurality of non-magnetic layers stacked in a laminating direction; and first, second, and third coils independent from each other and formed on the plurality of non-magnetic layers, wherein the first, second, and third coils include first, second, and third coil conductors, respectively, wherein the first coil conductor includes a first main portion having a spiral shape having one or more turns extending from a first inner circumference to a first outer circumference, wherein the second coil conductor includes a second main portion having a spiral shape having one or more turns extending from a second inner circumference to a second outer circumference, wherein the third coil conductor includes a third main portion having a spiral shape having one or more turns extending from a third inner circumference to a third outer circumference, wherein the first and third coil conductors deviate from the second coil conductor in a direction perpendicular to the laminating direction, wherein, viewing in the laminating direction, a portion of the second coil conductor at an N-th turn from the second inner circumference and a portion of the second coil conductor at an (N−1)-th turn from the second inner circumference are positioned between a portion of the first coil conductor at an N-th turn from the first inner circumference and a portion of the first coil conductor at an (N−1)-th turn from the first inner circumference, and are also positioned between a portion of the third coil conductor at an N-th turn from the third inner circumference and a portion of the third coil conductor at an (N−1)-th turn from the third inner circumference, where N is a number not less than 0 and not greater than a number of turns of the first coil conductor, wherein, viewing in the laminating direction, the portion of the first coil conductor at the (N−1)-th turn from the first inner circumference, the portion of the third coil conductor at the (N−1)-th turn from the third inner circumference, a portion of the first coil conductor at an (N−2)-th turn from the first inner circumference, and a portion of the third coil conductor at an (N−2)-th turn from the third inner circumference are positioned between the portion of the second coil conductor at the (N−1)-th turn from the second inner circumference and a portion of the second coil conductor at an (N−2)-th turn from the second inner circumference, and wherein, viewing in the laminating direction, none of the first coil conductor and the third coil conductor overlap the second coil conductor.

* * * * *